US005204228A

United States Patent [19]

Yoshimoto et al.

[11] Patent Number: 5,204,228

[45] Date of Patent: Apr. 20, 1993

[54] METHOD OF PROCESSING SILVER HALIDE COLOR PHOTOGRAPHIC LIGHT-SENSITIVE MATERIALS

[75] Inventors: Hiroshi Yoshimoto, Tokyo; Shigeharu Koboshi, Sagamihara, both of Japan

[73] Assignee: Konica Corporation, Tokyo, Japan

[21] Appl. No.: 720,701

[22] Filed: Jun. 25, 1991

[30] Foreign Application Priority Data

Jun. 29, 1990 [JP] Japan ..... 2-172374

[51] Int. Cl.[5] ..... G03C 7/42

[52] U.S. Cl. ..... 430/393; 430/430; 430/486; 430/433

[58] Field of Search ..... 430/393, 398, 400, 430, 430/567, 486, 933

[56] References Cited

U.S. PATENT DOCUMENTS

| | | | |
|---|---|---|---|
| 4,900,651 | 2/1990 | Ishikawa et al. | 430/486 |
| 4,907,023 | 3/1990 | Koboshi et al. | 354/321 |
| 4,912,017 | 3/1990 | Takagi et al. | 430/567 |
| 5,001,506 | 3/1991 | Nakamura | 354/324 |
| 5,002,859 | 3/1991 | Kuse et al. | 430/393 |
| 5,039,597 | 8/1991 | Nishijima | 430/383 |
| 5,104,775 | 4/1992 | Abe et al. | 430/393 |

FOREIGN PATENT DOCUMENTS

| | | |
|---|---|---|
| 0147148A2 | 7/1985 | European Pat. Off. . |
| 0327273A3 | 1/1989 | European Pat. Off. . |
| 0329088A2 | 2/1989 | European Pat. Off. . |
| 0429940A1 | 11/1990 | European Pat. Off. . |
| 2-46448(A) | 4/1990 | Japan . |
| 2-105148(A) | 7/1990 | Japan . |

*Primary Examiner*—Hoa Van Le

*Attorney, Agent, or Firm*—Finnegan, Henderson, Farabow, Garrett & Dunner

[57] ABSTRACT

A method of processing a silver halide color photographic light-sensitive material having a silver halide emulsion layer containing silver halie grains having a silver chloride content of not less than 80 mol %, wherein said silver halide color photographic material, after being subjected to color-development, is continuously processed with a bleaching solution comprising at least one of ferric complex salts of compounds represented by the following formula [A] or [B]:

Formula [A]

Formula [B]

8 Claims, No Drawings

METHOD OF PROCESSING SILVER HALIDE COLOR PHOTOGRAPHIC LIGHT-SENSITIVE MATERIALS

BACKGROUND OF THE INVENTION

The present invention relates to a method of processing silver halide color photographic light-sensitive materials. More particularly, the present invention relates to a processing method which is capable of rapid-processing, low in replenishing volume, improved in desilverizing capability, and excellent in processing stability.

In forming color images by photographic processing of an imagewise-exposed light-sensitive material, a desilvering process followed by a washing process or stabilizing process is generally provided after a color developing process. In recent years, light-sensitive materials have come to be processed in automatic provessing machines installed in processing laboratories. In such processing laboratories, there is demanded prompt service to finish processing of light-sensitive materials and return them to customers on the same day they are brought in for processing; recently, even returning within hours after bringing in has come to be requested. Accordingly, a technological development in rapid processing is ardently desired.

Under the circumstances, Eastman Kodak Company proposes a rapid processing for color paper called Process RA-4, which performs processing in 3 minutes at 35° C. by three steps comprising color developing of 45 seconds, bleach-fixing of 45 seconds and stabilizing of 90 seconds.

The prior art aimed at a rapid processing of light-sensitive materials can be roughly classified into three types, namely (1) techniques to improve light-sensitive materials,
(2) techniques relating to mechanical means in processing, and
(3) techniques to improve the composition of a processing. solution used in processing.

The above (1) includes [1] improvement in silver halide composition (for example, a technique to minimize the size of silver halide grains as described in Japanese Pat. O.P.I. Pub. No. 77223/1976 and a technique concerning silver halide having a low bromide content described in Japanese Pat. O.P.I. Pub. No. 18142/1983 and Japanese Pat. Examined Pub.No. 18939/1981), [2] use of additives (for example, a technique to add 1-aryl-3-pyrazolidone having a specific structure to a light-sensitive material as described in Japanese Pat. O.P.I. Pub. No. 64339/1981 and a technique to add 1-aryl-pyrazolidones to a light-sensitive material as described in Japanese Pat. O.P.I. Pub. Nos. 144547/1982, 50534/1983, 50535/1983 and 50536/1983), [3] techniques based on rapid reactive couplers (for example, couplers as described in Japanese Pat. Examined Pub. No. 10783/1976 and Japanese Pat. O.P.I. Pub. Nos. 123342/1975, 102636/1976), and [4] techniques relating to a photographic thin-layered structure (for example, a technique to thinned photographic component layers described in Japanese Pat. Application No. 204992/1085).

The above (2) includes techniques for stirring a processing solution (for example, a stirring technique described in Japanese Pat. Application No. 23334/1986).

The above (3) includes [1] techniques to use developing accelerators, [2] techniques to use high-concentration color developing agents and [3] techniques to reduce the concentration of halide ions, especially bromide ions.

In these rapid processing techniques, use of light-sensitive material containing a silver halide having a high silver chrolide content (a technique described, for example, in Japanese Pat. O.P.I. Pub. Nos.95345/1983, 19140/1985 and 95736/1983), which falls into (1) of the above category, can provide a particularly high rapid processability.

On the other hand, approach to rapid processing by raising desilverizing speed in desilvering process is also known. As bleaching agents used in desilverization, there have been used oxidizing agents such as ferricyanates, bichromates, persulfates and ferric chloride. However, these oxidizing agents are pollutive to environment; moreover, these are difficult to be reused by recovery, and thereby solutions after processing are compelled to be disposed of as waste.

To solve such a pollution problem as well as to meet the requirements for rapid and easy processing and for capability of recycling waste solutions, there has come to be widely used a processing solution containing a (ethylenediaminetetracetato) ferric complex salt as an oxidizing agent. But the processing solution using a (ethylenediamine-tetracetato) ferric complex salt has a disadvantage that the bleaching speed is low owing to the complex salt's slow oxidizing capability.

Though a longer processing time can prevent a poor desilverization, this is contradictory to the requirement for rapid processing.

As another method of rapid processing, the so-called bleach-fixing monobath in which a bleacher solution and fixer solution are mixed in one solution is practiced. And as a mean to accelelate the desilverization, a method of using a (diethylenetriaminepentacetato) ferric complex salt is disclosed in Japanese Pat. O.P.I. Pub. No. 149358/1984.

Further, Japanese Pat. O.P.I. Pub. No. 222252/1986 discloses a method to use ferric complex salts of diethylenetriamine pentacetic acid, cyclohexanediaminetetracetic acid and 1,3-diaminopropane tetracetic acid in combination therewith.

When a ferric diethylenetriamine pentacetate complex salt is used in a one-bath bleach-fixer solution, the desilverization speed is increased as compared with the case using a ferric diethylenetriamine tetracetate complex salt; but, it is still insufficient.

Further, when ferric complex salts of diethylenetriaminepentacetic acid, cyclohexanediamine tetracetic acid and 1,3-diaminopropane tetracetic acid are jointly used in a bleach-fixing bath, precipitation of sulfides occurs because the oxidation capability of a (1,3-diaminopropanetetracetato) ferric complex salt is too strong. As a result, the fixing capability is lowered; and when the replacement by a replenishing solution is small, tar tends to be generated and yellow stain is liable to increase.

SUMMARY OF THE INVENTION

An object of the present invention is to provide a method of processing silver halide color photographic light-sensitive materials which is improved in desilverizing in rapid processing, can reduce a replenishing volume and lower a pollution load, and possesses an excellent processing stability which allows both of continuous processing and small-batch processing over a long period of time.

The present inventors have made an intensive study and found that the above objects are attained by a method of processing a silver halide color photographic light-sensitive material, wherein a silver halide color photographic light-sensitive material comprising at least one silver halide emulsion layer containing silver halide grains having a silver chloride content of more than 80 mol % is color developed and then processed in a bleaching solution containing at least one of ferric complex salts of the organic acid represented by the following formula [A] or [B]:

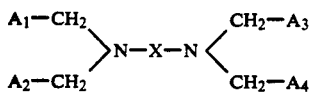

Formula [A]

wherein $A_1$ to $A_4$ which may be the same or different, represent —$CH_2OH$, —COOM or —$PO_3M_1M_2$; M, $M_1$ and $M_2$ individually represent hydrogen atom, alkali metal or ammonium; and X represents a substituted or unsubstituted alkylene group having 3 to 6 carbon atoms, and

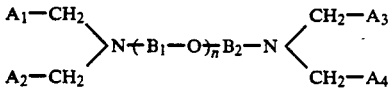

Formula [B]

wherein $A_1$ to $A_4$ are the same as those defined for Formula [A]; n represents an integer from 1 to 8; and $B_1$ and $B_2$, which may be the same or different, represent substituted or unsubstituted alkylene groups having 2 to 5 carbon atoms.

With regard to the foregoing, the present inventors have also found that the above object is attained much effectively, provided that ferric complex salts of the organic acid represented by Formula [A] or [B] is present at a concentration of not less than 0.1 mol per liter of bleacher solution, that the pH of said bleaching solution is not more than 5.5, that the replenishing volume of said bleacher solution is not more than 50 ml per square meter of a silver halide color photographic light-sensitive material, that the processing time in said bleaching solution is not more than 40 seconds, that the replenishing solution of said bleaching solution comprises a portion or the total of an overflowed bleaching solution which has processed different kinds of silver halide color photographic light-sensitive materials, and that the amount of silver in said silver halide color photographic light sensitive material is not more than 0.75 $g/m_2$.

The object of the invention is attained by using a silver-chloride-rich light-sensitive material and a ferric complex salt of a highly oxidative organic acid including 1,3-diaminopropane tetracetic acid and represented by Formula[A], or a ferric complex salt of an organic acid including glycoletherdiamine tetracetic acid and represented by Formula[B], and by separating the bleaching process form the fixing process. However, mechanisms why generation of tar can be prevented and why staining can be prevented are not clear.

In the invention, the bleaching solution contains a ferric complex salt of the organic acid represented by Formula [A] or [B] as a bleaching agent.

The compound represented by Formula [A] is hereunder described in detail.

In Formula [A], $A_1$ to $A_4$, which may be the same of different, represent —$CH_2OH$, —COOM or —$PO_3M_1M_2$; M, $M_1$ and $M_2$ independently represent a hydrogen atom, alkali metal (for example, sodium, potassium) or ammonium. X represents a substituted or unsubstituted alkylene group having 3 to 6 carbon atoms (for example, propylene, butylene, pentamethylene). Substituents are such as hydroxyl group and alkyl groups having 1 to 3 carbon atoms.

Preferred examples of the compound represented by Formula [A] are as follows:

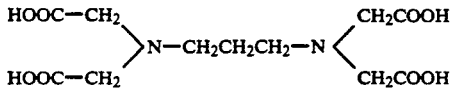

(A-1)

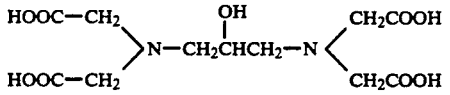

(A-2)

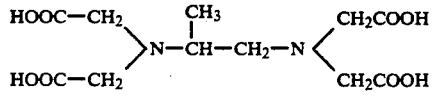

(A-3)

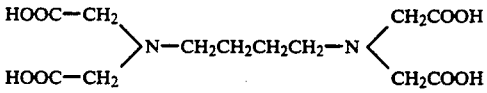

(A-4)

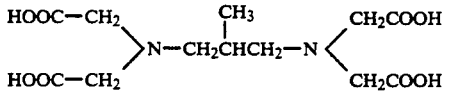

(A-5)

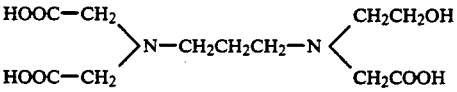

(A-6)

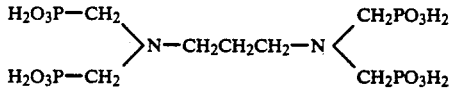

(A-7)

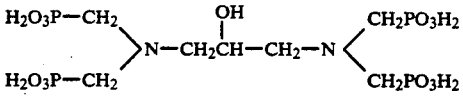

(A-8)

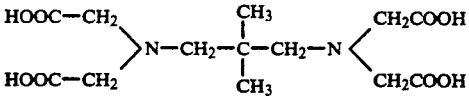

(A-9)

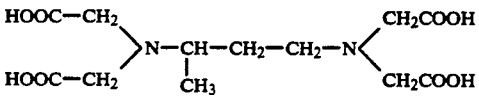

(A-10)

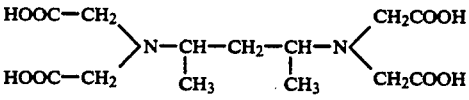

(A-11)

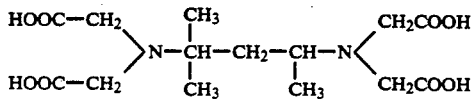

(A-12)

As ferric complex salts of these (A-1) to (A-12), there may be used any of sodium salt, potassium salt and ammonium salt of ferric complexes thereof. But, in view of the purpose of the invention and solubilities of these ferric complexes, ammonium salts and potassium salts are preferred.

Among the above exemplified compounds, (A-1), (A-3),(A-4), (A-5) and (A-9) are preferably used in the invention; (A-1) is particularly preferred.

Next, the compound represented by Formula [B] is described in detail.

In Formula [B], $A^1$ to $A^4$ are the same as the above, n represents an integer from 1 to 8, and $B^1$ and $B^2$ may be the same or different and represent substituted or unsubstituted alkylene groups (for example, ethylene, propylene, butylene, pentamethylene). Substituents are such as hydroxyl groups or lower alkyl groups having 1 to 3 carbon atoms (for example, methyl, ethyl, propyl).

Preferred examples of the compound represented by Formula [B] are as follows:

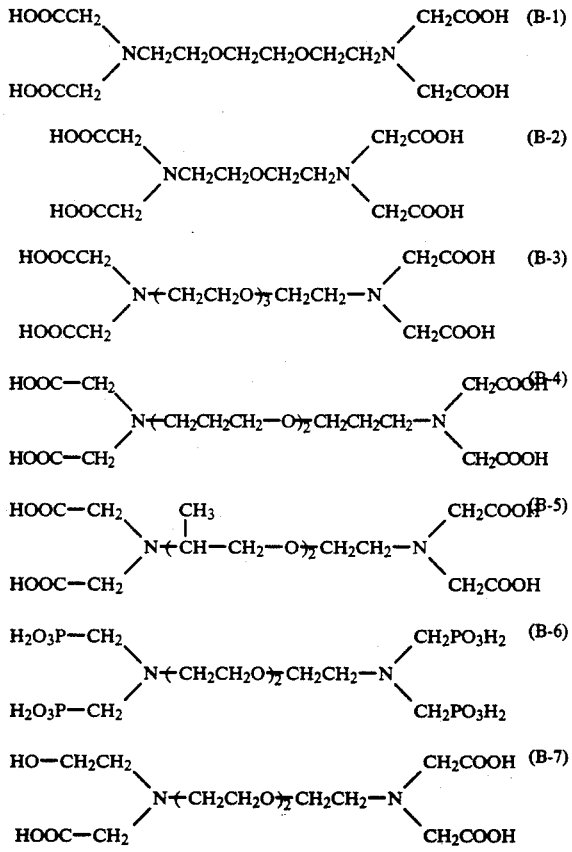

As ferric complex salts of these (B-1) to (B-7), there may be used any of sodium salt, potassium salt and ammonium salt of ferric complexes thereof.

Among the above exemplified compounds, (B-1), (B-2) and (B-7) are preferably used in the invention; (B-1) is particularly preferred.

The ferric complex salt of the organic acid represented by Formula [A] or [B] is contained generally in an amount of not less than 0.1 mol, preferably in a range from 0.2 to 1.5 mol per liter of the bleaching solution.

In the bleaching solution, ferric complex salts (for example, ammonium, sodium, potassium and triethanolamine salts) of the following compounds may be used as bleaching agents together with the compounds represented by Formula [A] or [B].

[A'-1] Ethylenediamine tetracetic acid
[A'-2] Trans-1,2-cyclohexanediamine tetracetic acid
[A'-3] Dihydroxyethyl
[A'-4] Ethylenediamide tetrakismethylene phosphonic acid
[A'-5] Nitrilotrismethylene phosphonic acid
[A'-6] Diethylenetriamine pentakismethylene phosphonic acid
[A'-7] Diethylenetriamine pentacetic acid
[A'-8] Ethylenediamine diorthohydroxyphenyl acetic acid
[A'-9] Hydroxyethylethylenediamine triacetic acid
[A'-10] Ethylenediamine dipropionic acid
[A'-11] Ethylenediamine diacetic acid
[A'-12] Hydroxyethyliminodiacetic acid
[A'-13] Nitrilotriacetic ascid
[A'-14] Nitrilotripropionic acid
[A'-15] Triethylenetetramine hexacetic acid
[A'-16] Ethylenediamine tetrapropionic acid These organic acid ferric complex salts may be used in the form of complex salt, or ferric complex ion may be formed in the solution using ferric salts such as ferric sulfate, ferric chloride, ferric acetate, ammonium ferric sulfate, ferric phosphate, and aminopolycarboxylic acids or salts thereof. When employed in the form of complex salt, they may be used singly or in combination. In case complex ions are formed in the solution from ferric salts and aminopolycarboxylic acids, ferric salts may be used singly or in combination of two or more kinds; aminopolycarboxylic acids may be also used singly or in combination of two or more kinds. In both cases, aminopolycarboxylic acids may be used excessively over an amount necessary to form ferric ion complex salts.

Further, in a bleaching solution containing the above ferric complex salt, there may coexist complex salts of metal ions other than ferric ions, such as cobalt, copper, nickel and zinc ions.

Moreover, the rapid processability can be improved by adding to the bleaching solution at least one of imidazole compounds or their derivatives described in the specification of Japanese Pat. Application No. 48931/1988, or compounds represented by Formulas [I] to [IX] described in the same specification or their exemplified compounds.

In addition to the above bleaching accelerators, there may be used for the same purpose compounds exemplified on pages 51 to 115 of the specification of Japanese Pat. Application No. 263568/1985, compounds exemplified on pages 22 to 25 of the specification of Japanese Pat. O.P.I. Pub.No. 17445/1988, and compounds described in Japanese Pat. O.P.I. Pub. Nos. 95630/1978 and 28426/1978.

These bleaching accelerators may be used singly or in combination. The addition amount is generally in a range of about 0.01 to 100 g, preferably 0.05 to 50 g, and especially 0.05 to 15 g per liter of the bleacher solution.

In general, these bleaching accelerators are dissolved in water, alkalis or organic acids prior to addition, but they may be added as they are; organic solvents such as methanol, ethanol and acetone may be used when necessary.

The pH of the bleaching solution is generally not more than 5.5, preferably 2.5 to 5.5.

Said pH is that of a working solution in which a silver halide light-sensitive material is being processed and clearly distinguished from that of a replenishing solution.

The temperature of the bleaching solution is in a range of 20° to 50° C., preferably 25° to 45° C.

The processing time in the bleaching solution is not longer than 40 seconds, preferably not longer than 30 seconds and especially not longer than 25 seconds; therefore, the effect of the invention becomes more remarkable in rapid processing. The term "processing time in the bleaching solution" means a time from when the head of a light-sensitive material starts to dip into the bleaching solution till the head comes out of the bleaching solution.

In general, the bleaching solution uses halides such as ammonium bromide, potassium bromide and sodium bromide. Fluorescent brighteners, defoamers and surfactants may also be added thereto.

The preferred replenishing volume of the bleaching solution for color paper is not more than 50 ml, more preferably not more than 30 ml per square meter of a light-sensitive material. For color negative film, it is generally not more than 180 ml and preferably not more than 140 ml per squaremeter of a light-sensitive material. The effect of the invention becomes much remarkable as the replenishing volume decreases.

It is preferable that a portion or all of replenishing solution of the bleacher solution be composed of an overflowed bleaching solution which has processed different kinds of silver halide color photographic light-sensitive materials.

To be concrete, in a dual-processing line using bleaching baths A and B, for example, the overflowed bleacher solution from bleaching bath A is utilized as a replenishing solution for bleaching bath B.

Light-sensitive materials to be processed in the bleaching baths A and B have only to be different in kinds There may be various combinations of light-sensitive materials, such as color negative film and color paper; color negative film or color paper and color reversal film or paper; color negative film and color negative film different from each other in AgCl content, AgBr content or sensitivity; and color paper and color paper different in AgCl content, AgBr content or sensitivity. Of them, combination of color negative film and color paper is particularly preferred in the invention. In the invention, activity of the bleacher solution may be enhanced, if desired, by blowing air into the processing bath or replenishing solution tank, or by adding thereto suitable oxidizing agents such as hydrogen peroxide, bromates or persulfates.

Next, there will be described a fixer solution used in the fixing process which follows the bleaching process.

As fixing agents contained in the fixer solution, thiosulfates and/or thiocyanates are preferably used. The addition amount of thiosulfates is preferably not less than 0.4 mol/l, and that of thiocyanates is preferably not less than 0.5 mol/l.

Besides these fixing agents, the fixer solution may contain, singly or in combination, pH buffers comprising various compounds such as boric acid, borax, sodiumhydroxide, potassium hydroxide, sodium carbonate, sodiumbicarbonate, potassium bicarbonate, acetic acid, sodiumacetate and ammonium hydroxide.

There may be preferably added to the fixer solution, in large amounts, halogenation agents comprising alkalihalides or ammonium halides such as potassium bromide, sodiumbromide, sodium chloride and ammonium bromide. Further, there are optionally added pH buffers such as borates, oxalates, acetates, carbonates and phosphates, and compounds usually known to be added to a fixer solution such as alkylamines and polyethylene oxides.

The ammonium ion concentration of the fixer solution is generally less than 50 mol %, preferably less than 20 mol % per total ions. More preferably, an ammonium concentration of 0 to 10 mol % prevents stains when a light sensitive material is subjected to fixing process directly from the bleaching bath, and this reduced ammonium content is also useful for pollution prevention. However, a low ammonium ion concentration occasionally excerts an adverse effect on the fixing capability; therefore, the preferred embodiment of the invention is to jointly use thiocyanates in an amount of 0.5 mol/l to 3.0 mol/l, or to adjust the concentration of thiosulfates to more than 0.4 mol/l, preferably more than 1.0 mol/l and especially 1.2 mol/l to 2.5 mol/l.

Silver may be recovered from the fixer solution by methods known in the art. Useful silver recovering methods are, for example, the electrolysis method described in French Pat. No. 2,299,667; the precipitation method disclosed in Japanese Pat. O.P.I. Pub.-No.73037/1977 and German Pat. No. 2,331,220; the ion exchange method disclosed in Japanese Pat. O.P.I. Pub. No. 17114/1976 and German Pat. 2,548,237; and metal substitution method described in British Pat. No. 1,353,805.

In view of the rapid processability, it is particularly preferable that an in line silver recovery from a tanked solution be practiced using electrolysis or an ion exchange resins. Of course, silver recovery from an overflowed waste solution is also applicable.

The replenishing volume of the fixer solution is less than 1,200 ml, preferably 20 ml to 1,000 ml, and especially 50 ml to 800 ml per square meter of a light-sensitive material.

The pH of the fixer solution is preferably in a range from 4 to 8.

The fixer solution may use compounds represented by Formula [FA] set forth on page 56 of the specification of Japanese Pat. Application No. 48931/1988 or exemplified compounds thereof, so that generation of sludge is noticeably reduced even when small batches of light-sensitive materials are processed with the fixer solution over a long period of time.

The compounds represented by Formula [FA] given in the above specification can be synthesized by those general methods which are described in U.S. Pat. Nos. 3,335,161 and 3,260,718. These compounds may be used singly or in combination. Favorables results are obtained by adding the compounds of Formula [FA] in an amount of 0.1 g to 200 g per liter of the processing solution.

The fixer solution may contain sulfites and sulfite-releasing compounds, such as potassium sulfite, sodium sulfite, ammonium sulfite, ammonium hydrogensulfite, potassium hydrogensulfite, sodium hydrogensulfite, potassium metabisulfite, sodiummetabisulfite and ammonium metabisulfite. Further, there may also be contained compounds represented by Formula [B-1] or [B-2] shown on page 60 of the specification of Japanese Pat. Application No. 48931/1988.

These sulfites and sulfurous-acid-releasing compounds are contained at least 0.05 mol as sulfurous ions per liter of the fixer solution. This value is desirably in a range from 0.08 mol/l to 0.65 mol/l, more desirably 0.10 mol/l to 0.5 mol/l, and most desirably 0.12 mol/l to 0.40 mol/l.

The processing time in the fixer solution can be arbitrarily selected, but it is generally less than 6 minutes and 30 seconds, preferably in a range from 5 seconds to 4 minutes and 20 seconds, and especially in a range from 10 seconds to 3 minutes and 20 seconds.

In embodying the invention, it is preferable that the bleaching solution and fixer solution be subjected to forced stirring. This facilitates the effect of the invention and enhances the rapid processability. The term "forced stirring" used here means to conduct a forced stirring using a stirring means, not a usual diffusive moving of the solution. As means for forced stirring, those described in Japanese Pat. Application No. 48930/1988 and Japanese Pat. O.P.I. Pub. No. 206343/1989 can be used.

In the invention, the cross over time for a light-sensitive material to transfer between tanks, such as that from color developing tank to bleaching tank, is preferably not more than 7 seconds in order to improve bleach fog, which is another effect of the invention. Further, one of other preferable embodiments of the invention is to use a duckbill valve for minimization of the volume of a processing solution brought in by a light-sensitive material.

After the fixing process according to the invention, a stabilizing process with a stabilizer solution is preferably carried out.

In the invention, it is particularly preferable that the stabilizer solution contain a chelating agent having achelate stability constant of 8 or more against ferric ions. The term "chelate stability constant" used here means a constant known by "Stability Constant of Metal-ion Complexes" by L. G. Sillen and A. E. Martell, The Chemical Society, London (1964) and "Organic Sequestering Agents" by S. Chaberek and A. E. Martell, Wiley (1959).

Chelating agents having a chelate stability constant of 8 or more against ferric ions include organic acid chelating agents, organic phosphoric acid chelating agents, inorganic phosphoric acid chelating agents and polyhydroxy compounds.

Examples of the chelating agent having a chelate stability constant of 8 or more against ferric ions are the following compounds, but not limited to them. Namely, ethylenediaminediorthohydroxyphenyl acetic acid, diaminopropane tetraceticacid, nitrilotriatetic acid, hydroxyethylenediamine triaceticacid, dihydroxyethyl glycine, ethylenediamine diacetic acid, ethylenediamine dipropionic acid, iminodiacetic acid, diethylenetriamine pentacetic acid, hydroxyethyliminodiacetic acid, diaminopropanol tetracetic acid, transcyclohexanediamine tetraecic acid, glycoletherdiaminetetracetic acid, ethylenediaminetetrakismethylene phosphonicacid, nitrilotrimethylene phosphonic acid,1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonoic acid, sodium pyrophosphate, sodium tetrapolyphosphate and sodium hexametaphosphate. Among them, diethylenetriamine pentacetic acid, nitrilotriacetic acid, nitrilotrimethylene phosphonic acid and 1-hydroxyethylidene-1,1-diphosphonic acid are preferred; 1-hydroxyethylidene-1,1-diphosphonic acid is particularly preferred.

The addition amount of the above chelating agent is preferably 0.01 to 50 g, and especially 0.05 to 20 g per liter of the stabilizer solution.

Other compounds which are preferably added to the stabilizer solution are ammonium compounds. These are fed as inorganic amonium salts such as ammonium hydroxide, ammonium bromide, ammonium carbonate, ammonium chloride, ammonium hypophosphite, ammonium phosphate, ammonium phosphite, ammonium fluoride, acid ammonium fluoride, ammonium fluoroborate, ammonium arsenate, ammonium hydrogencarbonate, ammonium hydrofluoride, ammonium hydrogensulfate, ammoniumsulfate, ammonium iodide, ammonium nitrate, ammoniumpentaborate, ammonium acetate, ammonium adipate, ammonium tricarboxylate, ammonium benzoate, ammonium calbamate, ammonium citrate, ammonium diethyldithiocarbamate, ammoniumformate, ammonium hydrogenmalate, ammonium hydrogenoxalate, ammonium phthalate, ammonium hydrogentartrate, ammoniumthiosulfate, ammonium sulfite, ammonium ethylenediaminetetracetate, ammonium ferric ethylenediamine tetracetate, ammonium lactate, ammonium malate, ammonium maleate, ammoniumoxalate, ammonium picrate, ammoniumpyrrolidinedithiocarbamate, ammonium salicylate, ammoniumsuccinate, ammonium sulfanilate, ammonium tartarate, ammoniumthioglycolate and ammonium 2.4.6-trinitrophenylate. These compounds may be used singly or in combination. The addition amount thereof is preferably in a range of 0.001 to 1.0 mol, especially 0.002 to 2.0 mols per liter of the stabilizer solution.

Further, it is preferable that the stabilizer solution contain sulfites. While said sulfites may be any of those organic and inorganic compounds which release sulfite ions, the preferred are inorganic sulfites. Preferable examples include sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite. These sulfates are added to the stabilizer solution in an amount at least $1\times10^{-3}$ mol/l, and preferably $5\times10^{-3}$ to $10^{-1}$ mol/l; this excerts a good effect particulaly on stain prevention. These may be directly incorporated in the stabilizer solution, but addition to the replenishing stabilizer solution is preferred.

Other known compounds to be added to the stabilizer solution are polyvinylpyrrolidone (PVP K-15, K-30, K-90), organic acid salts (citrates, acetates, succinates, oxalates, benzoates, etc.), pH conditioners (phosphates, borates, hydrochloric acid, sulfuric acid, etc.), fungicides (phenolderivatives, catechol derivatives, imidazole derivatives, triazole derivatives, derivatives, organic halides, fungicides known as slime controlling agents in paper & pulpmaking, etc.), fluorescent brighteners, surfactants, preservatives, and salts of metals such as Bi, Mg, Zn, Ni, Al, Sn, Ti, Zr. These compounds can be arbitrarily used within the limits not to impair the effect of the invention.

In the invention, no washing process is needed after the stabilizing process, but there may be carried out, if necessary, a short-time rinsing or surface cleaning with a small amount of water.

In order to bring out the effect of the invention most effectively, it is preferable that soluble iron ions be present in the stabilizer solution.

The concentration of the soluble iron ions is at least $5\times10^{-3}$ mol/l, preferably in a range from $8\times10^{-3}$ to $150\times10^{-3}$/l and especially from $12\times10^{-3}$ to $100\times10^{-3}$ mol/l. These may be added to the stabilizer solution (tanked solution) by being added to the stabilizer replenishing solution or by being dissolved from a light-sensitive material in the stabilizer solution, or these may be added to the stabilizer solution (tanked solution) by being brought from the preceding bath while adhering to a light-sensitive material under processing.

In the invention, there may be used a stabilizer solution in which calcium ions and magnesium ions were reduced to 5 ppm or less through ion-exchange resein treatment; further, the above fungicide and halogen-ion-releasing compound may be added thereto.

The pH of the stabilizer solution according to the invention is preferably in a range from 5.5 to 10.0; the stabilizer solution may contain any of pH conditioners which are known as an alkali and an acid in the art.

The stabilizing process is carried out in a temperature range of 15° to 70° C., preferably 20° to 55° C. The processing time is less than 120 seconds, preferably 3 to 90 seconds and especially 6 to 50 seconds.

In view of rapid processability and image preservability, it is preferable that replenishment of the stabilizer solution be 0.1 to 50 times and especially 0.5 to 30 times the volume brought from the preceding bath per unit area of a light-sensitive material.

Stabilizing tanks are composed desirably of plural tanks, namely, 2 or more and 6 or less; the more desirable is 2 to 3, and the most desirable is to arrange 2 tanks incounter current mode (the solution is replenished to the subsequent bath and overflowed from the preceding bath).

As color developing agents in the color developing process, aminophenol compounds and p-phenylenediamine compounds are used in general; however, p-phenylenediamine compounds having a water-soluble group are preferred in the invention.

That is, at least one of water-solublizing groups is present on the amino group or benzene ring of said p-phenylenediamine compound; examples of such a water-solublizing group are —$(CH_2)n—CH_2OH$,
—$(CH_2)m—NHSO_2—(CH_2)n—CH_3$,
—$(CH_2)m—O—(CH_2)n—CH_3$,
—$(CH_2CH_2O)nCmH_2m+1$,
—COOH and
—$SO_3H$, where m and n each represent an integer of 0 or more.

Typical examples of the color developing agent used in the invention are as follows:

[Exemplified color developing agents]

(A-1)

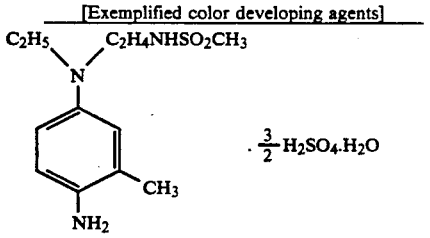

(A-2)

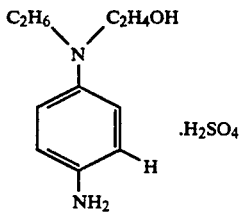

-continued

[Exemplified color developing agents]

(A-3)

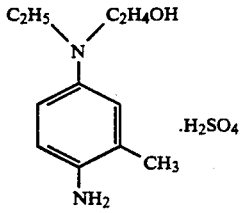

(A-4)

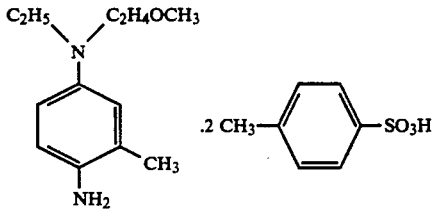

(A-5)

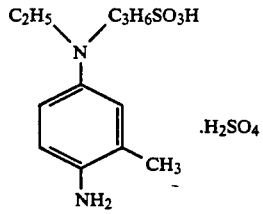

(A-6)

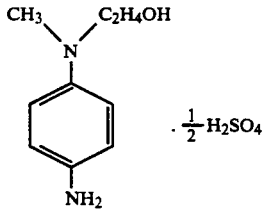

(A-7)

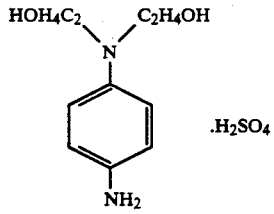

(A-8)

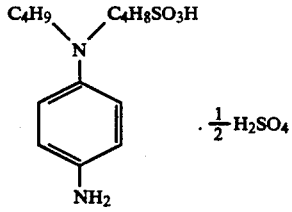

(A-9)

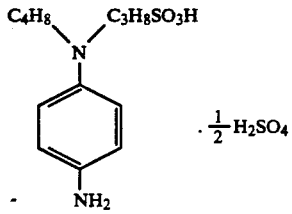

-continued

[Exemplified color developing agents]

(A-10)

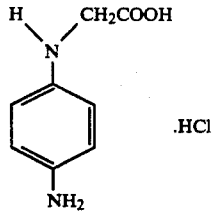

(A-11)

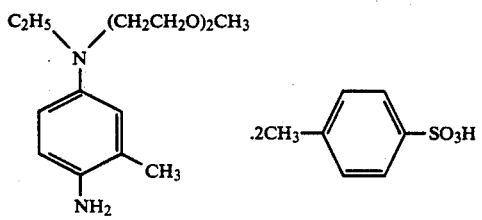

(A-12)

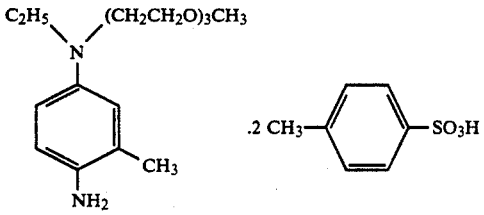

(A-13)

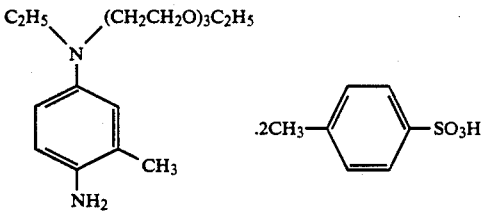

(A-14)

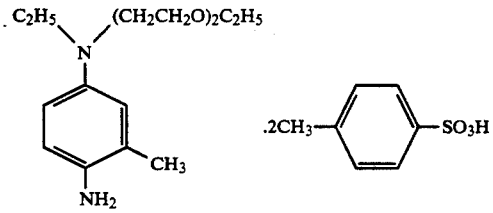

(A-15)

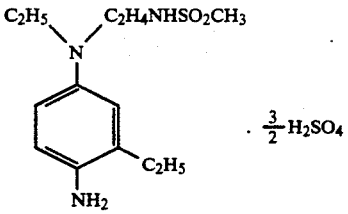

(A-16)

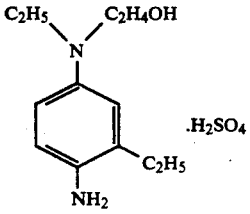

Among the above color developing agents, the preferred for the invention are those denoted by (A-1), (A-2), (A-3), (A-4), (A-6), (A-7) and (A-15), especially (A-1) and (A-3).

These color developing agents are used in the from of salts such as hydrochlorides, sulfates or p-toluenesulfonates.

The addition amount thereof is 0.5 mol or more, preferably $1.0\times10^{-2}$ to $1.0\times10^{-1}$ mol and especially $1.5\times10^{-2}$ to $7.0\times10^{-2}$ mol per liter of the color developer solution.

The color developer used in the color developing process may contain conventional alkalis employed in developers, such as sodium hydroxide, potassium hydroxide, ammonium hydrocide, sodium carbonate, potassium carbonate, sodium sulfate, sodium metaborate or borax. Further, there may also be contained other additives, such as benzyl alcohol; alkali halides including potassium bromide and potassium chloride; development control agents including citrazinic acid; and preservatives including hydroxylamine, hydroxylamine derivatives (e.g., diethylhydroxylamine), hydrazine derivatives (e.g., hydrazinodiacetic acid) and sulfites.

Moreover, defoamers, surfactants, and organic solvents such as methanol, dimethylformamide or dimethyl sulfoxide maybe optionally added thereto.

The pH of the color developer is generally 7 or more, preferably about 9 to 13.

When necessary, the color developer may use, as an antioxidant, tetronic acid, tetronimide, 2-anilinoethanol, dihydroxyacetone, secondary aromatic alcohols, hydroxamic acid, pentose, hexose, or pyrogallol-1,3-dimethylether.

For the purpose of sequestering metal ions, the color developer may use chelating agents selected from aminopolycarboxylic acids such as ethylenediamine tetraceticacid and diethylenetriamine pentacetic acid; organic phosphonic acids such as 1-hydroxyethylidene-1,1-diphosphonic acid; aminopolyphosphonic acids such as aminotrimethylenephosphonic acid and ethylenediamine tetraphosphoric acid; oxycarboxylic acids such as citric acid and gluconic acid; phosphonocarboxylic acids such as 2-phosphonobutane-1,2,4-tricarboxylic acid; and polyphosphoric acids such as tripolyphosphoric acid and hexametaphosphoric acid.

For color negative film, the replenishing volume of the color developer in continuous processing is less than 1,500 ml, preferably 250 ml to 900 ml and especially 300ml to 700 ml per square meter of a light-sensitive material; for color paper, it is preferably 20 to 300 ml and especially 30 to 160 ml.

To attain the object of the invention, it is preferable that the color developer solution of the invention contain a triazinylstilbene type fluorescent brightener. As such a fluorescent brightener, the compound represented by the following Formula (E) is preferred.

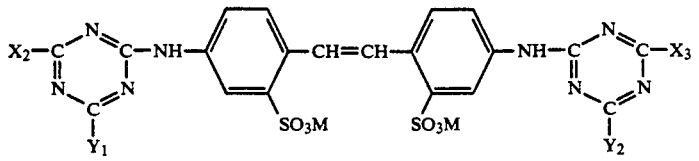

In the above formula, $X_2$, $X_3$, $Y_1$ and $Y_2$ independently represent a hydroxyl group; halogen atom such as chlorine or bromine; alkyl group; aryl group;

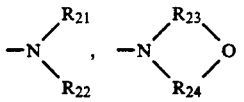

or —$OR_{25}$, where $R_{21}$ and $R_{22}$ independently represent a hydrogen atom, alkyl group (including substituted one), or aryl group (including substituted one); $R_{23}$ and $R_{24}$ represent an alkylene group (including substituted one); $R_{25}$ represents a hydrogen atom, alkyl group (including substituted one), or aryl group (including substituted one); and M represents a cation.

Detailes of groups and their substituents contained in Formula (E) are the same as those described in Japanese Patent Application No. 240400/1990 (page 63 to 64). Examples of the compound represented by Formula (E) are as follows:

| Compound | M | $X_2$ | $Y_1$ | $X_3$ | $Y_2$ |
|---|---|---|---|---|---|
| E-1 | Na | 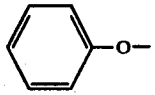 | $-NHC_2H_4OH$ | $-NHC_2H_4OH$ | 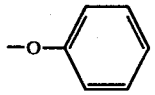 |
| E-2 | Na | $HOC_2H_4NH-$ | $-NHC_2H_4OH$ | $-NHC_2H_4OH$ | $-NHC_2H_4OH$ |
| E-3 | Na | 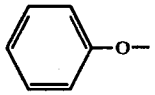 | $-N(C_2H_4OH)_2$ | $-N(C_2H_4OH)_2$ | 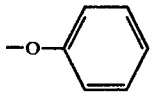 |
| E-4 | Na | $(HOC_2H_4)_2N-$ | $-OCH_3$ | $-OCH_3$ | $-NHC_2H_4SO_3Na$ |
| E-5 | Na | $HOHCH_2CNH-$ | $-N(C_2H_4OH)_2$ | $-N(C_2H_4OH)_2$ | $-NHCH_2CHOH$ <br> $\vert$ <br> $CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 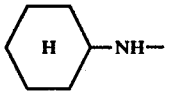 | $-NHC_2H_4OH$ | $-NHC_2H_4OH$ | 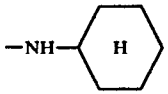 |
| E-8 | Na | 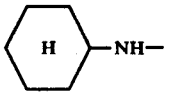 | $-N(C_2H_4OH)_2$ | $-N(C_2H_4OH)_2$ | 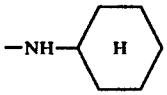 |
| E-9 | Na | $HO-$ | 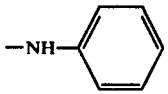 | 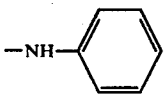 | $-OH$ |
| E-10 | Na | $H_2N-$ | 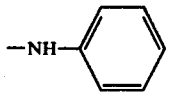 | 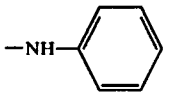 | $-NH_2$ |
| E-11 | Na | $CH_3O-$ | 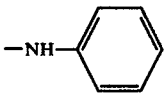 | 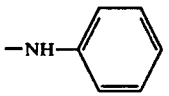 | $-OCH_3$ |

-continued
| Compound | M | $X_2$ | $Y_1$ | $X_3$ | $Y_2$ |
|---|---|---|---|---|---|
| E-12 | Na | $HOC_2H_4NH-$ | 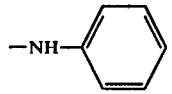 | 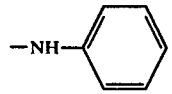 | $-NHC_2H_4OH$ |
| E-13 | Na | $-(HOC_2H_4)_2N$ | 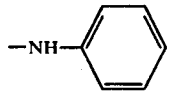 | 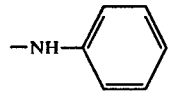 | $-N(C_2H_4OH)_2$ |
| E-14 | Na | $HOC_2H_4NH-$ | 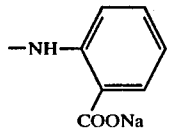 | 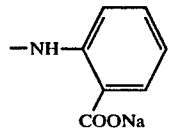 | $-NHC_2H_4OH$ |
| E-15 | Na | 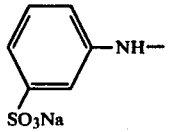 | $-N(C_2H_4OH)_2$ | $-N(C_2H_4OH)_2$ | 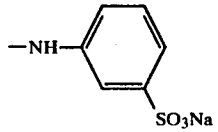 |
| E-16 | Na | 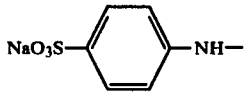 | $-N(C_2H_4OH)_2$ | $-N(C_2H_4OH)_2$ | 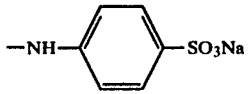 |
| E-17 | Na | 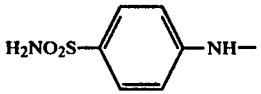 | $-N(C_2H_4OH)_2$ | $-N(C_2H_4OH)_2$ | 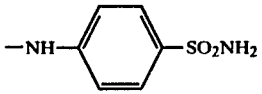 |
| E-18 | Na | 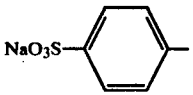 | $-N(C_2H_4OH)_2$ | $-N(C_2H_4OH)_2$ | 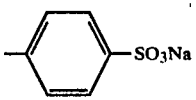 |
| E-19 | Na | $HOH_2CHCH_2CNH-$ <br> $\lvert$ <br> $CH_3$ | $-CH_3O$ | $-CH_3O$ | $-NHCH_2-CH-CH_2OH$ <br> $\lvert$ <br> $CH_3$ |

-continued
| Compound | M | $X_2$ | $Y_1$ | $X_3$ | $Y_2$ |
|---|---|---|---|---|---|
| E-20 | Na | $(HOC_2H_4)_2N-$ | 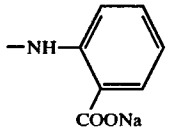 | 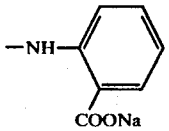 | $-N(C_2H_4OH)_2$ |
| E-21 | Na | $HOC_2H_4NH-$ | 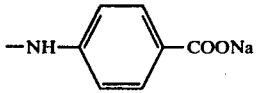 | 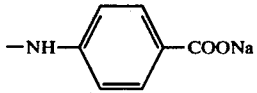 | $-NHC_2H_4OH$ |
| E-22 | Na | 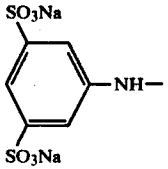 | $-NHC_2H_5$ | $-NHC_2H_5$ | 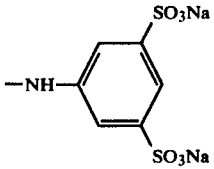 |
| E-23 | Na | 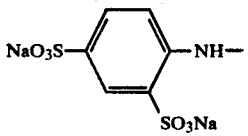 | $-NHCH_3$ | $-NHCH_3$ | 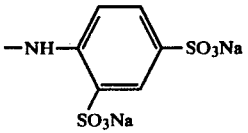 |
| E-24 | Na | 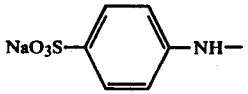 | 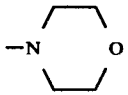 | 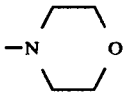 | 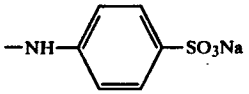 |
| E-25 | Na | $HOC_2H_4NH-$ | 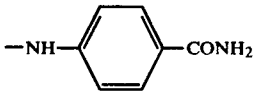 | 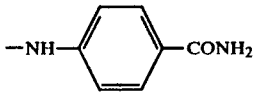 | $-NHC_2H_4OH$ |
| E-26 | Na | $HOC_2H_4NH-$ | 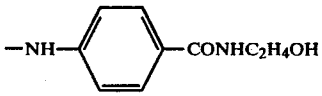 | 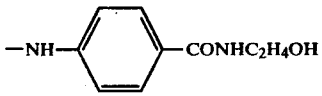 | $-NHC_2H_4OH$ |

-continued
| Compound | M | $X_2$ | $Y_1$ | $X_3$ | $Y_2$ |
|---|---|---|---|---|---|
| E-27 | Na | $(HOC_2H_4)_2N-$ | 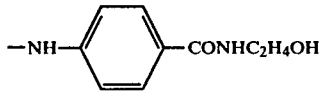 | 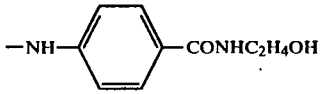 | $-N(C_2H_4OH)_2$ |
| E-28 | Na | $HOC_2H_4NH-$ | 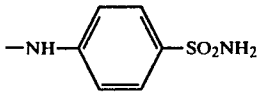 | 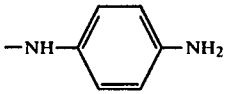 | $-NHC_2H_4OH$ |
| E-29 | Na | $HOC_2H_4NH-$ | 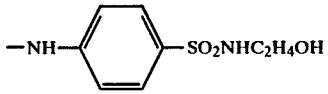 | 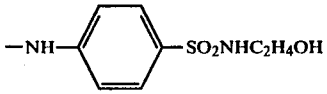 | $-NHC_2H_4OH$ |
| E-30 | Na | $(HOC_2H_4)_2N-$ | 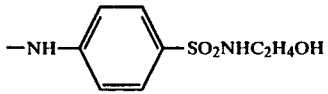 | 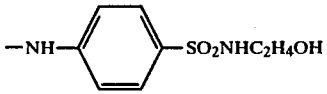 | $-N(C_2H_4OH)_2$ |
| E-31 | Na | 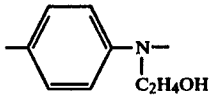 | 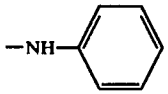 | 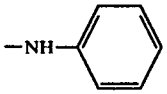 | 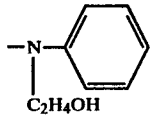 |
| E-32 | Na | 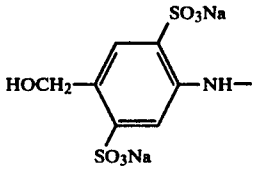 | 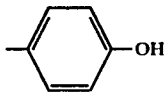 | 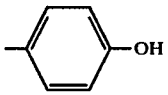 | 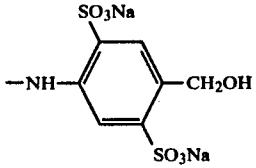 |
| E-33 | Na | 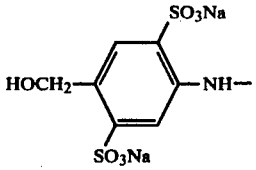 | $-NHC_2H_5$ | $-NHC_2H_5$ | 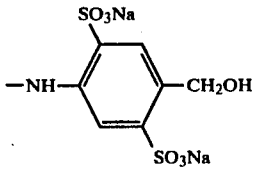 |
| E-34 | Na | $CH_3O-$ | $-NHCH_2CH(OH)CH_3$ | $-NHCH_2CH(OH)CH_3$ | $-OCH_3$ |

-continued
| Compound | M | $X_2$ | $Y_1$ | $X_3$ | $Y_2$ |
|---|---|---|---|---|---|
| E-35 | Na | 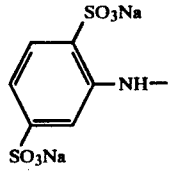 | 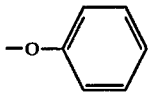 | 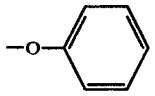 | 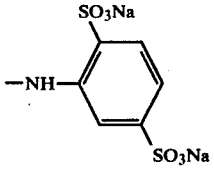 |
| E-36 | Na | 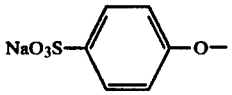 | $-N(C_2H_4OH)_2$ | $-N(C_2H_4OH)_2$ | 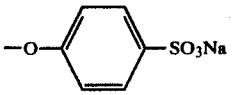 |
| E-37 | Na | 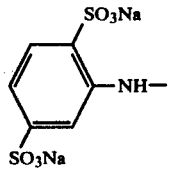 | $-N(C_2H_5)_2$ | $-N(C_2H_5)_2$ | 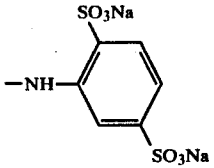 |
| E-38 | Na | 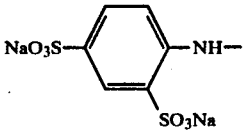 | $-NHCH_3$ | $-NHCH_3$ | 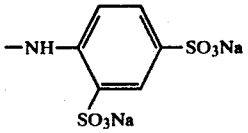 |
| E-39 | Na | $CH_3O-$ | $-NH-CH(CH_2OH)CH_3$ | $-NH-CH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NH(C_2H_4OH)$ | $-NH(C_2H_4OH)$ | $-OCH_3$ |
| E-43 | Na | $CH_3O-$ | 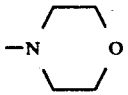 | 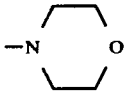 | $-OCH_3$ |
| E-44 | K | $CH_3O-$ | $-NHC_2H_4SO_3K$ | $-N(C_2H_4OH)_2$ | $-OCH_3$ |
| E-45 | H | 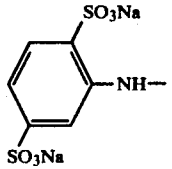 | $-N(C_2H_5)_2$ | $-N(C_2H_5)_2$ | 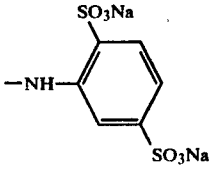 |

The above exemplified compounds can be synthesized by known methods. Among these compounds, the preferred are E-4, E-10, E-12, E-24, E-34, E-35, E-36, E-37, E-40, E-42, E-43 and E-44. The addition amount of these compounds is preferably 0.2 g to 10 g and especially 0.4 g to 5 g per liter of color developer solution.

Next, explanation will be made on the light-sensitive material to which the processing method of the invention is applied.

As silver halide grains contained in the light-sensitive material, silver halide grains having a silver chloride content of 80 mol % or more are generally used. The content is desirably 90 mol % or more, more desirably 95 mol % or more, and most desirably 99 mol % or more.

Such a silver halide emulsion grains may contain, other than silver chloride, silver bromide and/or silver iodide as silver halide components. In this case, the content of silver bromide is generally 20 mol % or less, preferably 10 mol % or less and especially 3 mol % or less. When silveriodide is present, its content is generally 1 mol % or less, preferably 0.5 mol % or less, and the especially preferred is zero. These silver halide grains containing 80 mol % or more of silver chloride is employed at least in one silver halide emulsion layer, preferably in all silver halide emulsion layers.

The crystal form of these silver halide grains may be any of regular crystals, twinned crystals and other crystal forms, and the ratio of (1.0.0) faces to (1.1.1) faces may be arbitrarily selected. The crystal structure thereof may be the same from inner portion to outer portion of grains, or may be a layered structure different in composition from inner portion to outer portion of grains (core/shell structure). Further, these silver halide grains may be grains which form latent images mainly on their surface, or ones which form latent images mainly at their inner portion. Moreover, there may also be used tabular silver halide grains (see Japanese Pat. O.P.I. Pub. No. 113934/1983 and Japanese Pat. Application No. 170070/1984) and silver halide grains described in Japanese Pat. O.P.I. Pub. Nos. 26837/1989,26838/1989 and 77047/1989.

The above silver halide grains may be formed by any of the acid method, neutral method and ammoniacal method. Combination of these methods is also useful. For example, there may be carried out a procedure in which seed grains are formed by the acid method and the resultant seed grains are then grown to a prescribed grain size by the ammoniacal method, which provides a much faster growth speed. In growing silver halide grains, it is preferable to control the pH and pAg in a reaction vessel appropriately, and to add silver ions and halide ions simultaneously in an amount proportional to the growth speed of silver halide grains as described, for example, in Japanese Pat. O.P.I. Pub. No.48521/1979.

The silver halide emulsion layer of the light-sensitive material to be processed according to the invention contains color couplers, which react with an oxidation product of a color developing agent to form non-diffusive dyes. These color couplers are preferably united into non-diffusive state in a light-sensitive layer or adjoining thereto.

Thus, the red-sensitive layer can contain, for example, a non-diffusive color coupler capable of forming cyan color images, a phenol or α-naphthol type coupler in general; the green-sensitive layer can contain, for example, at least one non-diffusive color coupler capable of forming magenta color images, a 5-pyrazolone type color coupler and pyrazolotriazole in general; and the blue-sensitive layer can contain, for example, at least one non-diffusive color coupler capable of forming yellow color images, a color coupler having an open-chained ketomethylene group in general. The color coupler may be a six-, four- or two-equivalent coupler. In the invention, a two-equivalent coupler is preferred.

Examples of suitable couplers may be found, for example, in the monograph "Farbkuppler" by W. Pelz on page 111 of Agfa's research paper "Mitteilungen aus den Forschungslaboratorien der Agfa", Leverkusen/-Munchen(1961), vol. III; "The Chemistry of Synthetic Dyes" by K. Venkataraman, Academic Press, vol. 4, pp. 341-387; "The Theory of the Photographic Process", 4th ed., pp. 353-362;and Research Disclosure No. 17643, sec. VII.

In view of the object of the invention, it is particularly preferable to use magenta couplers represented by Formula [M-I] shown on page 26 of the specification of Japanese Pat. O.P.I. Pub. No. 106655/1988 (typical examples thereof are those denoted by Nos. 1 to 77 on pages 29-34 of the same specification); cyan couplers represented by Formula [C-I] or [C-II] shown on page 34 of the same specification (typical examples thereof are those denoted by (C'-1) to(C'-82) and (C''-1) to (C''-36) on pages 37-42 of this specification); and high-speeed yellow couplers described on page 20 of the specification (typical examples thereof are those denoted by (Y'-1) to (Y'-39) on pages 21-26 of the specification).

Use of a nitrogen-containing heterocyclic mercapto compound in a light-sensitive material is one of the preferable embodiments of the invention, because it minimizes an adverse effect on photographic properties exerted when bleaching or fixing solution gets mixed in the developer solution.

Examples of such nitrogen-containing heterocyclic mercapto compounds are those denoted by (I'-1) to (I'-87) on pages 42-45 of the specification of Japanese Pat. O.P.I. Pub.No. 106655/1988.

The silver halide emulsion of the present invention can be chemically sensitized. Use of sulfur-containing compounds, such as allylisocyanate, allylthiourea and thiosulfate is particularly preferred. Reducing agents can also be used as chemical sensitizers; examples thereof are silver compounds described in Belgian Pat. Nos. 493,464, 568,687; polyamines such as diethylenetriamine according to Belgian Pat. No. 547,323; and aminomethylsulfine derivatives. Further, noble metals and salts thereof, such as gold, platinum, palladium, iridium, ruthenium and rhodium, are also useful sensitizers. This chemical sensitizing method is described on pages 65-72 of R. Kosiovsky's paper in "Zeitschrift fur Wissenschaftliche Photographie", vol.46 (1951); see the above Research Disclosure No. 17643, sec. III, too.

The silver halide emulsion can be spectrally sensitized by conventional methods with ordinary polymethine dyes such as neutrocyanine, basic or acidic carboxycyanine, rhodacyanine, hemicyanine; styryl dyes; and oxonol and analogues thereof. The spectral sensitization is described in the monograph "The Cyanine Dyes and Related Compounds" 1964, by F. M. Hamer; "Ullmanns Enzyklopadie der technischen Chemie", 4th ed., vol. 18, p. 431; and Research Disclosure No. 17643, sec. IV.

The silver halide emulsion may use conventional antifoggants and stabilizers. Azaindenes are suitable stabilizers; tetra- and penta-azaindene are preferred, and those substituted with a hydroxyl or amino group are particularly preferred. Compounds of this type are shown, for example, in Birr's paper in "Zeitschrift fur Wissenschaftliche Photographie", vol. 47 (1952), pp. 2–58; and Research Disclosure No. 17643, sec. IV.

The components of the light-sensive material can be contained by conventional methods; refer to U.S. Pat. Nos. 2,322,027, 2,533,514, 3,689,271, 3,764,336 and 3,765,897. Some of the components—for example, couplers and UV absorvents—can be contained in the form of charged latex as described in German Offenlegungshrift 2,541,274 and European Pat. Application 14,921. Also, some of the components can be fixed as a polymer in a light-sensitive material as seen, for example, in German Offenlegungshrift 2,044,992 and U.S. Pat. Nos. 3,370,952 and 4,080,211.

As supports of the light-sensitive material, conventional supports may be used. For example, color paper may use reflective supports such as paper supports, which may be coated with polyolefin such as polyethylene or polypropylene; see Research Disclosure No. 17643 sec. V and VI.

The method of the invention can be applied to any of coupler-containing light-sensitive materials to be processed by the so-called internal development, such as color paper, color negative film, color positive film, color reversal film for slides, color reversal film for movie, color reversalfilm for TV and reversal color paper.

EXAMPLES

The present invention is hereunder described in more detail with the examples, but the scope of the invention is not limited to these examples.

EXAMPLE 1

Multilayered silver halide color photographic light-sensitive material (1) was prepared by coating the layers having the following compositions on the titanium-oxide-containing polyethylene side of a paper support coated with titanium-oxide-containing polyethylene. The coating solutions were prepared as follows: Coationg solution for 1st layer There were dissolved 26.7 g of yellow coupler (Y-1), 10.0 g of dye image stabilizer (ST-1), 6.67 g of dye image stabilizer (ST-2) and 0.67 g of additive (HQ-1) in a mixture of 6.67 g of high boiling solvent (DNP) and 60 ml of ethylacetate. Then, the solution was dispesed, with a ultrasonic homogenizer, in 220 ml of a 10% gelatin aqueous solution containing 7 ml of a 20% solution of surfactant (SU-1) to prepare a yellow coupler dispersion. The dispersion was mixed with a blue-sensitive silver halide emulsion (containing 10 g of silver) prepared under the conditions described later.

Coating solutions for 2nd to 7th layers were prepared in the same manner as with the coating solution for 1st layer.

As hardeners, (H-1) was added in 2nd and 4th layers, and (H-2) in 7th layer. As coating aids, (SU-2) and (SU-3) were added to adjust surface tension.

| Layer | Composition | Addition amount (g/m$^2$) |
|---|---|---|
| 7th layer (protective layer) | gelatin | 1.0 |
| 6th layer (UV absorbing layer) | gelatin | 0.4 |
| | UV absorbent (UV-1) | 0.10 |
| | UV absorbent (UV-2) | 0.04 |
| | UV absorbent (UV-3) | 0.16 |
| | antistain agent (HQ-1) | 0.01 |
| | DNP | 0.2 |
| | PVP | 0.03 |
| | anti-irradiation dye (AI-2) | 0.02 |
| 5th layer (red-sensitive layer) | gelatin | 1.30 |
| | red-sensitive silver chlorobromide emulsion (Em-R) in terms of Ag | 0.21 |
| | cyan coupler (C-1) | 0.17 |
| | cyan coupler (C-2) | 0.25 |
| | dye image stabilizer (ST-1) | 0.20 |
| | antistain agent (HQ-1) | 0.01 |
| | HBS-1 | 0.20 |
| | DOP | 0.20 |
| 4th layer (UV absorbing layer) | gelatin | 0.94 |
| | UV absorbent (UV-1) | 0.28 |
| | UV absorbent (UV-2) | 0.09 |
| | UV absorbent (UV-3) | 0.38 |
| | antistain agent (HQ-1) | 0.03 |
| | DNP | 0.40 |
| 3rd layer (green-sensitive layer) | gelatin | 1.40 |
| | green-sensitive silver chlorobromide emulsion (Em-G) in Ag | 0.17 |
| | magenta coupler (M-1) | 0.35 |
| | dye image stabilizer (ST-3) | 0.15 |
| | dye image stabilizer (ST-4) | 0.15 |
| | dye image stabilizer (ST-5) | 0.15 |
| | DNP | 0.20 |
| | anti-irradiation dye (AI-1) | 0.01 |
| 2nd layer (intermediate layer) | gelatin | 1.20 |
| | antistain agent (HQ-2) | 0.12 |
| | DIDP | 0.15 |
| 1st layer (blue-sensitive layer) | gelatin | 1.20 |
| | blue-sensitive silver chlorobromide emulsion (Em-B) in Ag | 0.26 |
| | yellow coupler (Y-1) | 0.80 |
| | dye image stabilizer (ST-1) | 0.30 |

-continued
| | | |
|---|---|---|
| | dye image stabilizer (ST-2) | 0.20 |
| | antistain agent (HQ-1) | 0.02 |
| | anti-irradiation dye (AI-3) | 0.01 |
| | DNP | 0.20 |
| Support | polyethylene-laminated paper | |
Y-1
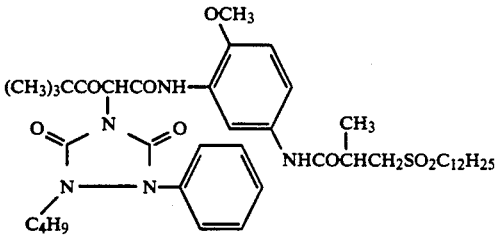
(M-1)
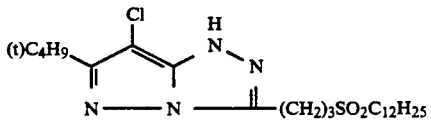
C-1
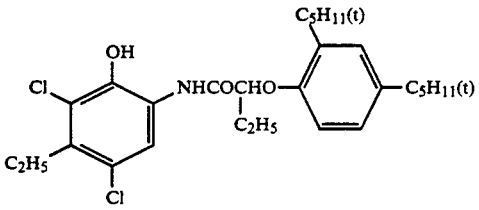
C-2
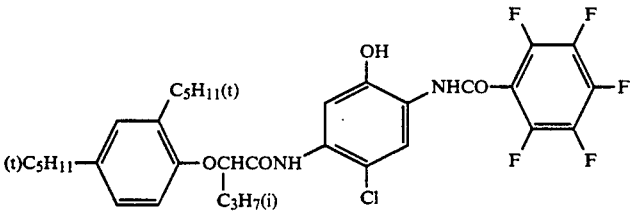
ST-1
ST-2
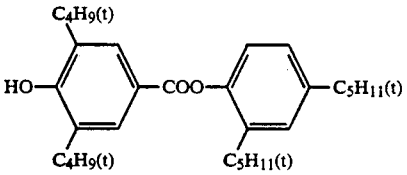
ST-3
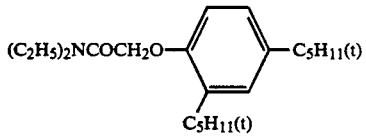
ST-4
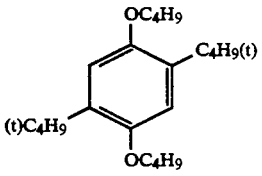
ST-5
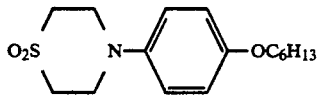
UV-1
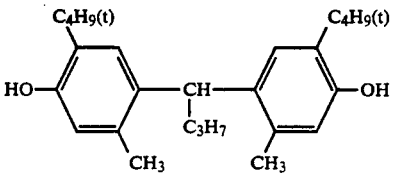
UV-2
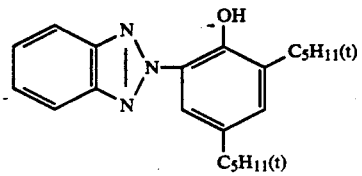
UV-3

-continued
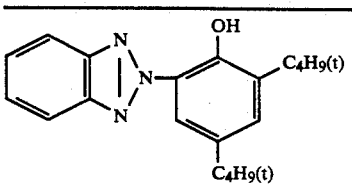
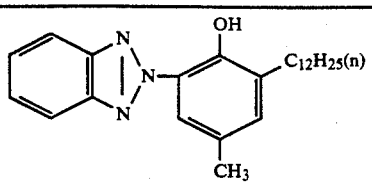
DOP: dioctyl phthalate
DIDP: diisodecyl phthalate
HQ-1
DNP: dinonyl phthalate
PVP: polyvinyl pyrrolidone
HQ-2
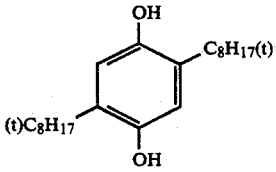
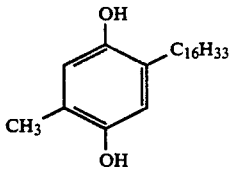
HBS-1
AI-1
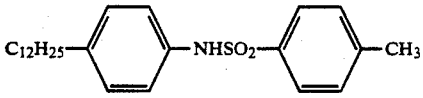
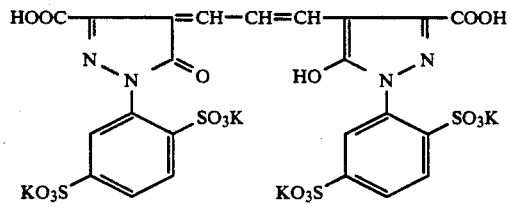
AI-2
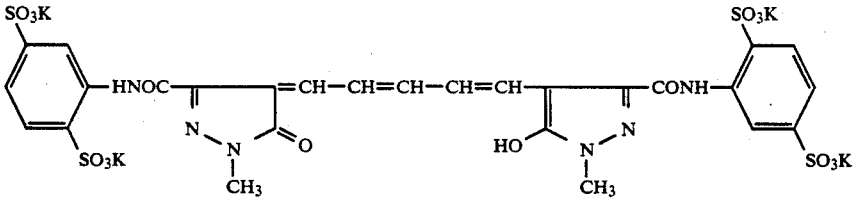
AI-3
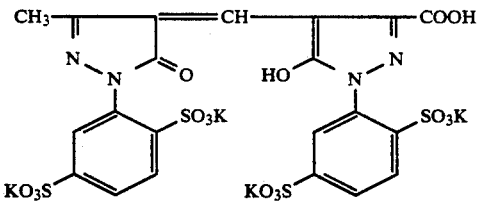
SU-1
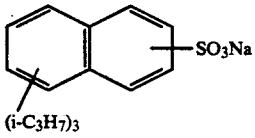
SU-2
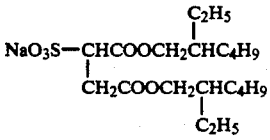
SU-3
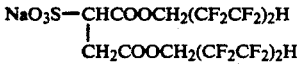
H-1
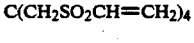
H-2
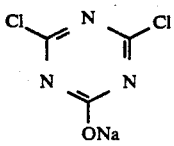

Preparation of Blue-sensitive Silver Halide Emulsion

The following (solution A) and (solution B) were simultaneously added to 1,000 ml of a 2% gelatin aqueous solution at 40° C. over a period of 30 minutes, while controlling pAg at 6.5 and pH at 3.0. Then, the following (solution C) and (solution D) were simultaneously added thereto over a period of 180 minutes, while controlling pAg at 7.3 and pH at 5.5. During the addition, control of the pAg was made according to the method described in Japanese Pat. O.P.I. Pub. No. 45437/1984, and control of the pH was made with an aqueous solution of sulfuric acid or that of sodium hydroxide.

| | |
|---|---|
| (solution A) | |
| Sodium chloride | 3.42 g |
| Potassium chloride | 0.03 g |
| water was added to make | 200 ml |
| (solution B) | |
| Sodium nitrate | 10 g |
| Water was added to make | 200 ml |
| (solution C) | |
| Sodium chloride | 102.7 g |
| Potassium bromide | 1.0 g |
| Water was added to make | 600 ml |
| (solution D) | |
| Silver nitrate | 300 g |
| Water was added to make | 600 ml |

After completing the addition, desalination was conducted using a 5% aqueous solution of Demol N made by Kao Atlas and a 20% aqueous solution of magnesium sulfate, and the emulsion obtained was mixed with an aqueous solution of gelatin. Monodispersed cubic emulsion EMP-1 thus obtained had an average grain size of 0.85 μm, variation coefficient (σ/r) of 0.07 and silver chloride content of 99.5 mol %.

Emulsion EMP-1 was then subjected to chemical sensitization for 90 minutes at 50° C. using the following compounds, so that a blue-sensitive silver halide emulsion (Em-B) was prepared.

| | |
|---|---|
| Sodium thiosulfate | 0.8 mg/mol AgX |
| Cloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of Green-sensitive Silver Halide Emulsion

Monodispersed cubic emulsion EMP-2 having an average grain size of 0.43 μm, variation coefficient (σ/r) of 0.08 and silver chloride content of 99.5 mol % was prepared in the same manner as with EMP-1, except that addition time of (solution A) and (solution B) and that of (solution C) and solution D) were changed.

Then, EMP-2 was subjected to chemical sensitization for 120 minutes at 55° C. using the following compounds to obtain a green-sensitive silver halide emulsion (Em-G).

| | |
|---|---|
| Sodium thiosulfate | 1.5 mg/mol AgX |
| Cloroauric acid | 1.0 mg/mol AgX |
| Stabilizer (STAB-1) | $6 \times 10^{-4}$ mol/mol AgX |
| Sensitizing dye (GS-1) | $4 \times 10^{-4}$ mol/mol AgX |

Preparation of Red-sensitive Silver Halide Emulsion

Monodispersed cubic emulsion EMP-3 having an average grain size of 0.50 μm, variation coefficient (σ/r) of 0.08 and silver chloride content of 99.5 mol % was prepared in the same manner as with EMP-1, except that addition time of (solution A) and (solution B) and that of (solution C) and (solution D) were changed.

Then, EMP-3 was subjected to chemical sensitization for 90 minutes at 60° C. using the following compounds to obtain a red-sensitive silver halide emulsion (Em-R).

| | |
|---|---|
| Sodium thiosulfate | 1.8 mg/mol AgX |
| Cloroauric acid | 2.0 mg/mol AgX |
| Stabilizer (STAB-1) | $6 \times 10^{-4}$ mol/mol AgX |
| Sensitizing dye (RS-1) | $1 \times 10^{-4}$ mol/mol AgX |

BS-1

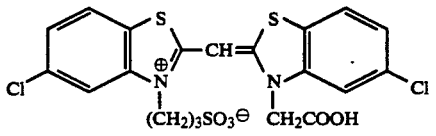

BS-2

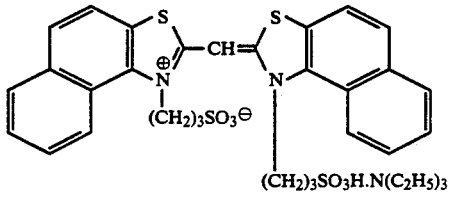

GS-1

-continued

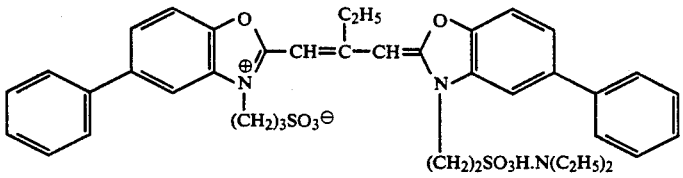

RS-1

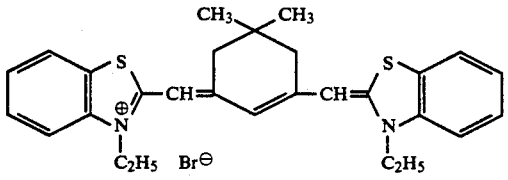

STAB-1

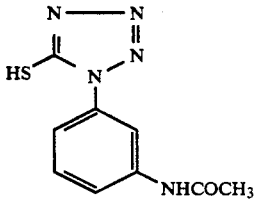

Samples prepared as above were subjected to conventional wedge exposure and then to running treatment according to the following processing (1):

| Process (1) | Temperature (°C.) | Time (sec) | Replenished volume (ml/m$^2$) |
|---|---|---|---|
| Color developing | 38 | 20 | 61 |
| Bleaching | 38 | 20 | 30 |
| Fixing | 38 | 20 | 30 |
| Stabilizing* | 30 | 1st tank: 20<br>2nd tank: 20 | 101 |
| Drying | 60 to 80 | 30 | |

Notes:
*The 1st and 2nd tanks of the stabilizing bath were arranged in a counter current mode, and replenishment was made to the 2nd tank.

Compositions of the processing solutions were as follows:

| (Color developer tank solution) | |
|---|---|
| Diethylene glycol | 15 g |
| Potassium bromide | 0.01 g |
| Potassium chloride | 2.3 g |
| Potassium sulfite (50% solution) | 0.5 ml |
| Color developing agent [3-methyl-4-amino-N-ethyl-N-(β-methanesulfonamidoethyl)-aniline sulfate] | 6 g |
| Diethylhydroxylamine (85%) | 5 g |
| Triethanol amine | 10 g |
| Potassium carbonate | 30 g |
| Ethylenediamine tetracetic acid | 2 g |
| Fluorescent brightener (PK-Conc., product of Nisso ) | 2 g |

Water was added to make the total volume 1 liter, and pH was adjusted to 10.15 with potassium hydroxide or sulfuric acid.

| (Color developer replenishing solution) | |
|---|---|
| Diethylene glycol | 17 g |
| Potassium chloride | 3 g |
| Potassium sulfite (50% solution) | 1.0 ml |

-continued

| (Color developer replenishing solution) | |
|---|---|
| Color developing agent [3-methyl-4-amino-N-ethyl-N-(β-methanesulfonamidoethyl)-aniline sulfate] | 8.8 g |
| Diethylhydroxylamine (85%) | 7 g |
| Triethanol amine | 10 g |
| Potassium carbonate | 30 g |
| Ethylenediamine tetracetic acid | 2 g |
| Fluorescent brightener (PK-Conc., product of Nisso) | 2.5 g |

Water was added to make the total volume 1 liter, and pH was adjusted to 11.0 with potassium hydroxide or sulfuric acid.

| (Bleaching tank solution) | |
|---|---|
| Organic acid ferric complex salt (see Table 1) | |
| Ethylenediamine tetracetate | 2 g |
| Ammonium bromide | 178 g |
| Glacial acetic acid | 50 ml |

Water was added to 1 liter, and pH was adjusted to a value shown in Table 1 with aqueous ammonia or glacial acetic acid.

Bleaching Replenisher

Organic acid ferric complex salt (see Table 1, the addition amount was increased by 20%)

| | |
|---|---|
| Ethylenediamine tetracetate | 2 g |
| Ammonium bromide | 178 g |
| Glacial acetic acid | 50 ml |

Water was added to 1 liter, and pH was adjusted to a value shown in Table 1 with aqueous ammonia or glacial acetic acid. (Fixer tank solution and fixer replenishing solution)

| | |
|---|---|
| Ammonium thiosulfate | 180 g |
| Ammonium thiocyanate | 120 g |

-continued

| | |
|---|---|
| Sodium metabisulfite | 3 g |
| Ethylenediamine tetracetic acid | 0.8 g |

Water was added to make 1 liter, and pH was adjusted to pH 6.5 with acetic acid and aqueous ammonia.

Stabilizer Tank Solution and Stabilizer Replenishing Solution

| | |
|---|---|
| Orthophenylphenol | 0.15 g |
| $ZnSO_4.7H_2O$ | 0.2 g |
| Ammonium sulfite (40% solution) | 5.0 ml |
| 1-hydroxyethylidene-1,1-diphosphonic acid (60% solution) | 2.5 g |
| Ethylenediamine tetracetic acid | 2.0 g |
| Fluorescent brightener (Cinopearl SFP, product of Ciba-Geigy) | 2.0 g |

pH was adjusted to 7.8 with aqueous ammonia or sulfuric acid, and water was added to make 1 liter.

The light-sensitive material sample was subjected to running treatment by being processed with an amtomatic processing machine filled with the above tank solutions of color developer, bleacher, fixer and stabilizer, while there plenishing solutions of color developer, bleacher, fixer and stabilizer were fed through a measuring pump at 3-minute intervals. This running treatment was carried on till there plenished volume came to twice the volume of the tank solution.

After the running treatment, the reflected yellow density of an unexposed portion of the processed wedge was measured. The amount of residual silver in an exposed portion was also measured by the X-ray fluorometry. Further, the processing solutions of experiment Nos. (1-1), (1-2), (1-3), (1-4), (1-5), (1-6), (1-23), (1-24), (1-25), (1-26) and (1-27) were preserved at 38° C. after completion of the running treatment and then checked for generation of tar (tarring).

Next, samples were processed by the following process (2) instead of process (1) and evaluated likewise.

| Process (2) | Temperature (°C.) | Time (sec) | Replenished volume (ml/m²) |
|---|---|---|---|
| Color developing | 38 | 20 | 61 |
| Blea-fixing | 38 | 40 | 90 |
| Stabilizing | 30 | 1st tank: 20<br>2nd tank: 20 | 101 |
| Drying | 60 to 80 | | 30 |

(Bleach-fixer tank solution and replenishing solution)

| | |
|---|---|
| Organic acid sodium ferric salt (see Table 1) | |
| Ethylenediamine tetracetic acid | 3 g |
| Ammonium thiosulfate (70% solution) | 123 g |
| Ammonium sulfite (40% solution) | 51 g |

pH was adjusted as shown in Table 1 with aqueous ammonia or sulfuric acid, and water was added to make 1 liter.

TABLE 1

| Experiment No. | Organic acid iron complex salt: Compound | Organic acid iron complex salt: Addition amount (mol/l) | pH | Process | Yellow density of unexposed portion | Residual silver amount of exposed portion (mg/100 cm²) | Tarring |
|---|---|---|---|---|---|---|---|
| 1-1 | EDTA.Fe | 0.30 | 4.5 | (1) | 0.08 | 0.8 | A |
| 1-2 | NTA.Fe | 0.30 | 4.5 | (1) | 0.07 | 1.4 | A |
| 1-3 | CyDTA.Fe | 0.30 | 4.5 | (1) | 0.07 | 0.9 | A |
| 1-4 | EDTMP.Fe | 0.30 | 4.5 | (1) | 0.08 | 0.8 | A |
| 1-5 | NTMP.Fe | 0.30 | 4.5 | (1) | 0.08 | 0.8 | A |
| 1-6 | (A-1).Fe | 0.30 | 4.5 | (1) | 0.08 | 0.0 | A |
| 1-7 | (A-4).Fe | 0.30 | 4.5 | (1) | 0.08 | 0.0 | |
| 1-8 | (A-7).Fe | 0.30 | 4.5 | (1) | 0.09 | 0.0 | |
| 1-9 | (A-9).Fe | 0.30 | 4.5 | (1) | 0.07 | 0.0 | |
| 1-10 | (A-1).Fe | 0.05 | 4.5 | (1) | 0.06 | 0.4 | |
| 1-11 | (A-1).Fe | 0.10 | 4.5 | (1) | 0.09 | 0.2 | |
| 1-12 | (A-1).Fe | 0.19 | 4.5 | (1) | 0.09 | 0.1 | |
| 1-13 | (A-1).Fe | 0.23 | 4.5 | (1) | 0.09 | 0.0 | |
| 1-14 | (A-1).Fe | 0.40 | 4.5 | (1) | 0.10 | 0.0 | |
| 1-15 | (A-1).Fe | 0.50 | 4.5 | (1) | 0.10 | 0.0 | |
| 1-16 | (A-1).Fe | 0.60 | 4.5 | (1) | 0.11 | 0.0 | |
| 1-17 | (A-1).Fe | 0.30 | 1.5 | (1) | 0.06 | 0.2 | |
| 1-18 | (A-1).Fe | 0.30 | 2.0 | (1) | 0.06 | 0.1 | |
| 1-19 | (A-1).Fe | 0.30 | 3.0 | (1) | 0.06 | 0.0 | |
| 1-20 | (A-1).Fe | 0.30 | 4.0 | (1) | 0.07 | 0.0 | |
| 1-21 | (A-1).Fe | 0.30 | 5.0 | (1) | 0.07 | 0.0 | |
| 1-22 | (A-1).Fe | 0.30 | 5.5 | (1) | 0.09 | 0.1 | |
| 1-23 | (A-1).Fe | 0.30 | 6.0 | (1) | 0.12 | 0.2 | B |
| 1-24 | DTPA.Fe/ | 0.30 | 4.5 | (2) | 0.12 | 0.2 | B |
| 1-25 | (A-1).Fe | 0.30 | 4.5 | (2) | 0.20 | more than 0.3 mg | C |
| 1-26 | DTPA.Fe/ CyDTA.Fe/ (A-1).Fe | 0.1/0.1/0.1 | 4.5 | (2) | 0.15 | 1.0 mg | C |
| 1-27 | (B-1).Fe | 0.30 | 4.5 | (1) | 0.08 | 0.0 | A |

In the table, meanings of respective abbreviations are; EDTA.Fe: sodium iron (III) ethylenediamine tetracetato, NTA.Fe: sodium iron (III) nitrilotriacetato, CyDTA.Fe: sodium iron (III), 2-cyclohexanediamine tetracetato, EDTMP.Fe: sodium iron (III) ethylenediaminetetramethylene phosphonato, NTMP.Fe: sodium iron (III) nitrilotrimethylene phosphonato, DTPA.Fe: sodium iron (III) diethylenetriamine pentacetato, and (A-1).Fe: sodium iron (III) salt of (A-1).

The rating of tar generation is;

A: no tar

B: slight tar

C: tar is obviously observed

D: heavy tar

It is seen from Table 1 that the effect of the invention is favorably brought about when a light-sensitive material having a silver chloride content of 80 mol % or more is processed in a bleacher solution containing a specific organic acid ferric complex salt. Further, it is understood, from experiment Nos. 1-15 to 1-21 and 1-6, that the effect of the invention is favorably exerted when the addition amount of the organic acid ferric complex salt of the compound according to the invention is 0.1 mol/l or more and preferably 0.2 to 1.5 mol/l; from experiment Nos. 1-22 tol-28 and 1-6, that a bleacher solution's pH less than 5.5, particularly 2.5 to 5.5, yields good results, and from experiment Nos. 1-29 to 1-31 and 1-6, that the effect of the invention is much obviously demonstrated when process (1) issued.

EXAMPLE 2

A multilayered color photographic light-sensitive material sample was prepared by forming the following layers in sequence on a triacetylcellulose film support.

| (Light-sensitive material) | Addition amount |
|---|---|
| 1st layer: antihalation layer | |
| Black colloidal silica | 0.2 |
| UV absorbent (UV-1) | 0.23 |
| High boiling solvent (Oil-1) | 0.18 |
| Gelatin | 1.4 |
| 2nd layer: 1st intermediate layer | |
| Gelatin | 1.3 |
| 3rd layer: low-speed red-sensitive layer | |
| Silver iodobromide emulsion (average grain size: 0.4 μm, AgI: 2.0 mol %) | 1.0 |
| Sensitizing dye (SD-1) | $1.8 \times 10^{-5}$ mol/mol Ag |
| Sensitizing dye (SD-2) | $2.8 \times 10^{-4}$ mol/mol Ag |
| Sensitizing dye (SD-3) | $3.0 \times 10^{-4}$ mol/mol Ag |
| Cyan coupler (C-1) | 0.70 |
| Colored cyan coupler (CC-1) | 0.066 |
| DIR compound (D-1) | 0.03 |
| DIR compound (D-3) | 0.01 |
| High boiling solvent (Oil-1) | 0.64 |
| Gelatin | 1.2 |
| 4th layer: medium-speed red-sensitive layer | |
| Silver iodobromide emulsion (average grain size: 0.7 μm, AgI: 8.0 mol %) | 0.8 |
| Sensitizing dye (SD-1) | $2.1 \times 10^{-5}$ mol/mol Ag |
| Sensitizing dye (SD-2) | $1.9 \times 10^{-4}$ mol/mol Ag |
| Sensitizing dye (SD-3) | $1.9 \times 10^{-4}$ mol/mol Ag |
| Cyan coupler (C-1) | 0.28 |
| Colored cyan coupler (CC-1) | 0.027 |
| DIR compound (D-1) | 0.01 |
| High boiling solvent (Oil-1) | 0.26 |
| Gelatin | 0.6 |
| 5th layer: high-speed red-sensitive layer | |
| Silver iodobromide emulsion (average grain size: 0.8 μm, AgI: 8.0 mol %) | 1.7 |
| Sensitizing dye (SD-1) | $1.9 \times 10^{-5}$ mol/mol Ag |
| Sensitizing dye (SD-2) | $1.7 \times 10^{-4}$ mol/mol Ag |
| Sensitizing dye (SD-3) | $1.7 \times 10^{-4}$ mol/mol Ag |
| Cyan coupler (C-1) | 0.05 |
| Cyan coupler (C-2) | 0.10 |
| Colored cyan coupler (CC-1) | 0.02 |
| DIR compound (D-1) | 0.025 |
| High boiling solvent (Oil-1) | 0.17 |
| Gelatin | 1.2 |
| 6th layer: 2nd intermediate layer | |
| Gelatin | 0.8 |
| 7th layer: low-speed green-sensitive layer | |
| Silver iodobromide emulsion (average grain size: 0.4 μm, AgI: 2.0 mol %) | 1.1 |
| Sensitizing dye (SD-4) | $6.8 \times 10^{-5}$ mol/mol Ag |

-continued

| (Light-sensitive material) | Addition amount |
|---|---|
| Sensitizing dye (SD-5) | $6.2 \times 10^{-4}$ mol/mol Ag |
| Magenta coupler (M-1) | 0.54 |
| Magenta coupler (M-2) | 0.19 |
| Colored magenta coupler (CM-1) | 0.06 |
| DIR compound (D-2) | 0.017 |
| DIR compound (D-3) | 0.01 |
| High boiling solvent (Oil-2) | 0.81 |
| Gelatin | 1.8 |
| 8th layer: medium-speed green-sensitive layer | |
| Silver iodobromide emulsion (average grain size: 0.7 μm, AgI: 8.0 mol %) | 0.7 |
| Sensitizing dye (SD-6) | $1.9 \times 10^{-4}$ mol/mol Ag |
| Sensitizing dye (SD-7) | $1.2 \times 10^{-4}$ mol/mol Ag |
| Sensitizing dye (SD-8) | $1.5 \times 10^{-5}$ mol/mol Ag |
| Magenta coupler (M-1) | 0.07 |
| Magenta coupler (M-2) | 0.03 |
| Colored magenta coupler (CM-1) | 0.04 |
| DIR compound (D-2) | 0.018 |
| High boiling solvent (Oil-2) | 0.30 |
| Gelatin | 0.8 |
| 9th layer: high-speed green-sensitive layer | |
| Silver iodobromide emulsion (average grain size: 1.0 μm, AgI: 8.0 mol %) | 1.7 |
| Sensitizing dye (SD-6) | $1.2 \times 10^{-4}$ mol/mol Ag |
| Sensitizing dye (SD-7) | $1.0 \times 10^{-4}$ mol/mol Ag |
| Sensitizing dye (SD-8) | $3.4 \times 10^{-6}$ mol/mol Ag |
| Magenta coupler (M-1) | 0.09 |
| Magenta coupler (M-3) | 0.04 |
| Colored magenta coupler (CM-1) | 0.04 |
| High boiling solvent (Oil-2) | 0.31 |
| Gelatin | 1.2 |
| 10th layer: yellow filter layer | |
| Yellow colloidal silver | 0.05 |
| Antistain agent (SC-1) | 0.1 |
| High boiling solvent (Oil-2) | 0.13 |
| Gelatin | 0.7 |
| Formalin scavenger (HS-1) | 0.09 |
| Formalin scavenger (HS-2) | 0.07 |
| 11th layer: low-speed blue-sensitive layer | |
| Silver iodobromide emulsion (average grain size: 0.4 μm, AgI: 2.0 mol %) | 0.5 |
| Silver iodobromide emulsion (average grain size: 0.7 μm, AgI: 8.0 mol %) | |
| Sensitizing dye (SD-9) | $5.2 \times 10^{-4}$ mol/mol Ag |
| Sensitizing dye (SD-10) | $1.9 \times 10^{-5}$ mol/mol Ag |
| Yellow coupler (Y-1) | 0.65 |
| Yellow coupler (Y-2) | 0.24 |
| DIR compound (D-1) | 0.03 |
| High boiling solvent (Oil-2) | 0.18 |
| Gelatin | 1.3 |
| Formalin scavenger (HS-1) | 0.08 |
| 12th layer: high-speed blue-sensitive layer | |
| Silver iodobromide emulsion (average grain size: 1.0 μm, AgI: 8.0 mol %) | 1.0 |
| Sensitizing dye (SD-9) | $1.8 \times 10^{-4}$ mol/mol Ag |
| Sensitizing dye (SD-10) | $7.9 \times 10^{-5}$ mol/mol Ag |
| Yellow coupler (Y-1) | 0.15 |
| Yellow coupler (Y-2) | 0.05 |
| High boiling solvent (Oil-2) | 0.074 |
| Gelatin | 1.30 |
| Formalin scavenger (HS-1) | 0.05 |
| Formalin scavenger (HS-2) | 0.12 |
| 13th layer: 1st protective layer | |
| Fine grain silver iodobromide emulsion (average grain size: 0.08 μm, AgI: 1 mol %) | 0.4 |
| UV absorbent (UV-1) | 0.07 |
| UV absorbent (UV-2) | 0.10 |
| High boiling solvent (Oil-1) | 0.07 |
| High boiling solvent (Oil-3) | 0.07 |

-continued

| (Light-sensitive material) | Addition amount |
|---|---|
| Formalin scavenger (HS-1) | 0.13 |
| Formalin scavenger (HS-2) | 0.37 |
| Gelatin | 1.3 |
| 14th layer: 2nd protective layer | |
| Alkali-soluble matting agent (average particle size: 2 μm) | 0.13 |
| Polymethylmethacrylate (average particle size: 3 μm) | 0.02 |
| Slipping agent (WAX-1) | 0.04 |
| Gelatin | 0.6 |

Besides the above compounds, there were used coating aid Su-1, dispersing aid Su-2, viscosity controller, hardeners H-1 and H-2, stabilizer ST-1 and antifoggants AF-1 (Mw:10,000) and AF-2 (Mw: 1,100,000).

The emulsions used in the above sample were prepared utilizing the procedure of Example 1. Each emulsion was optimumly subjected to gold.sulfur sensitization. The average grain sizes used above are grain sizes of cubes converted from actual shapes.

C-1

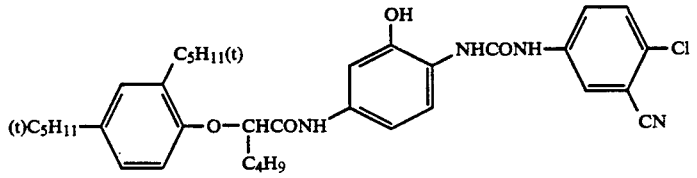

C-2

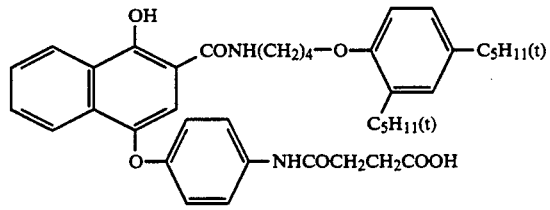

M-1

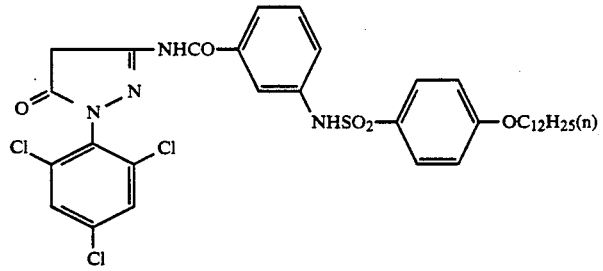

M-2

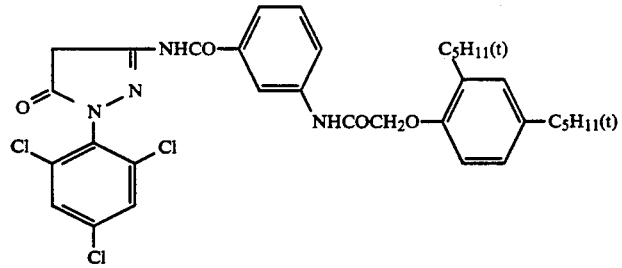

Y-1

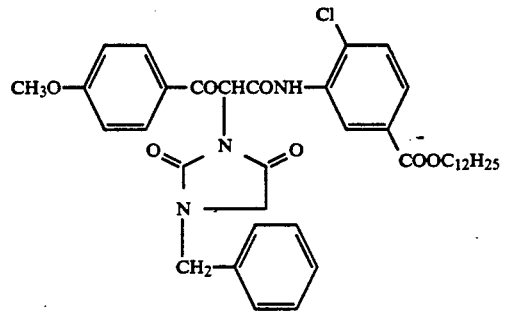

-continued
Y-2
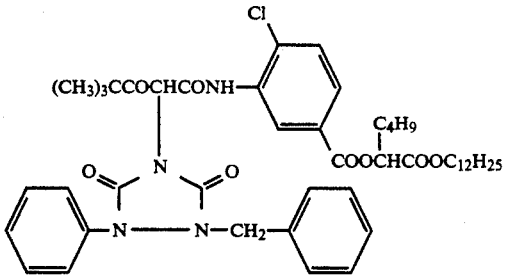
CC-1
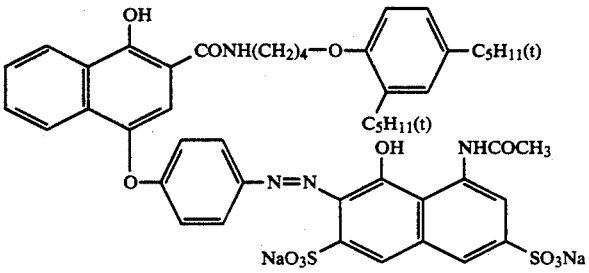
CM-1
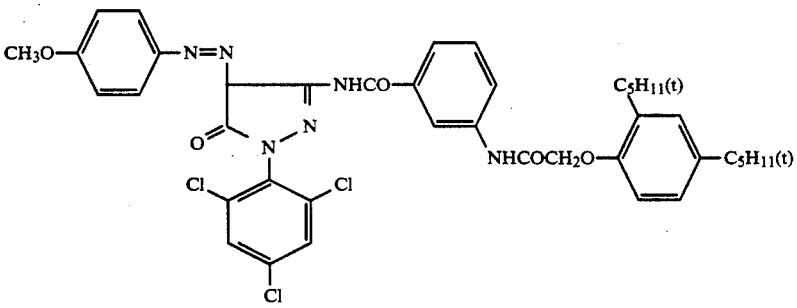
D-1
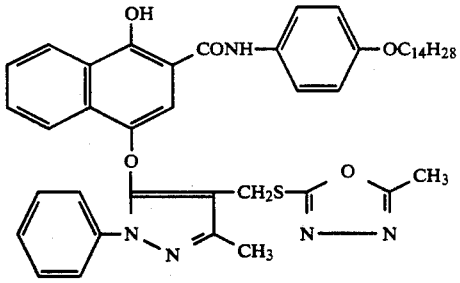
D-2
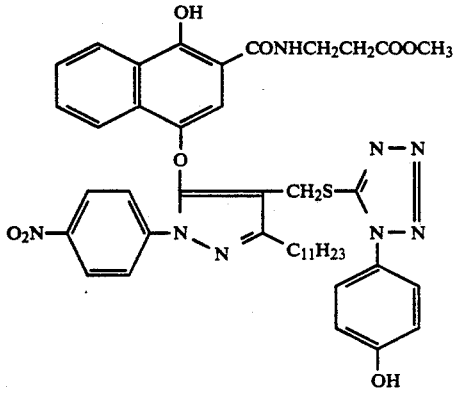

-continued
D-3
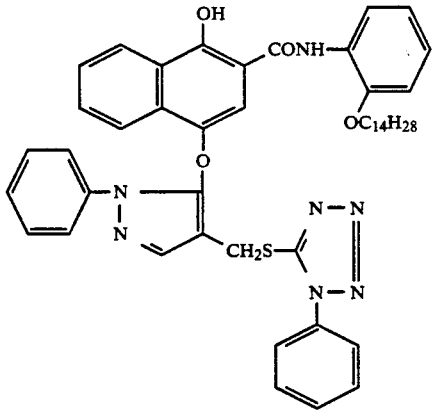
Oil-1
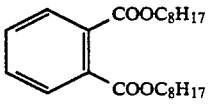
Oil-2
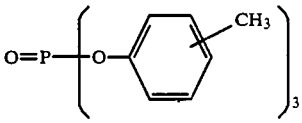
Oil-3
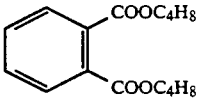
SC-1
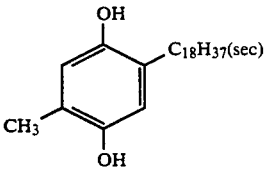
UV-1
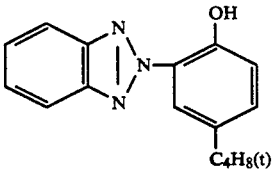
UV-2
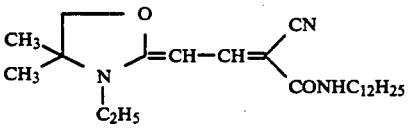
WAX-1
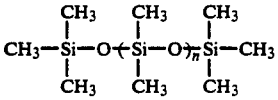
weight-average molecular weight Mw = 3,000
Su-1
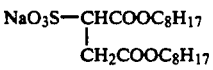

-continued
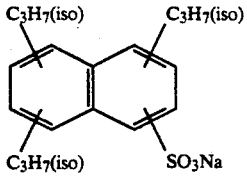
Su-2
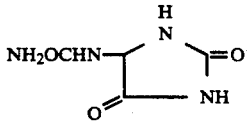
HS-1
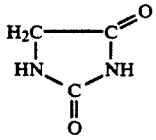
HS-2
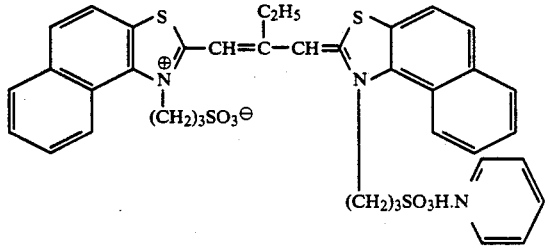
SD-1
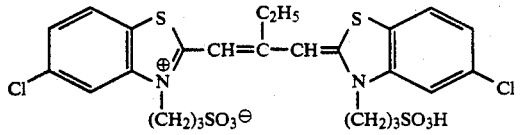
SD-2
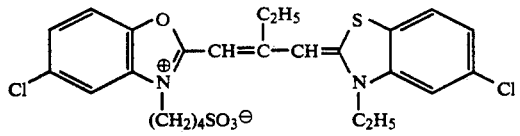
SD-3
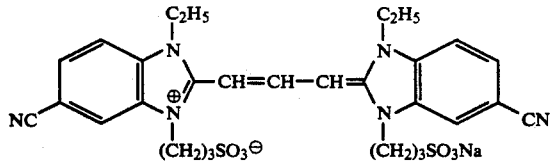
SD-4
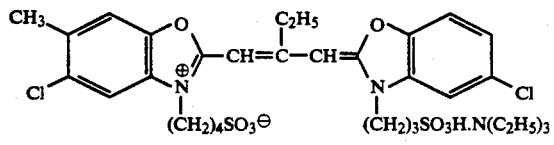
SD-5
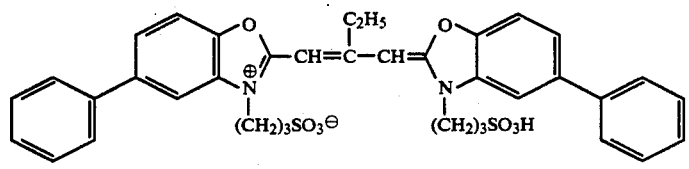
SD-6

-continued

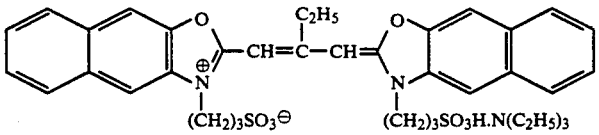

SD-7

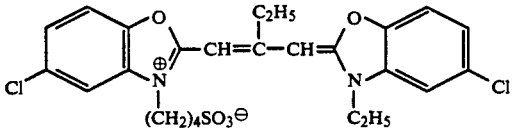

SD-8

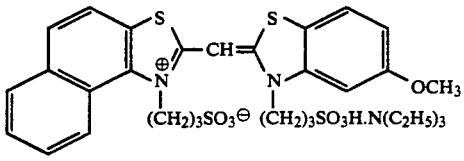

SD-9

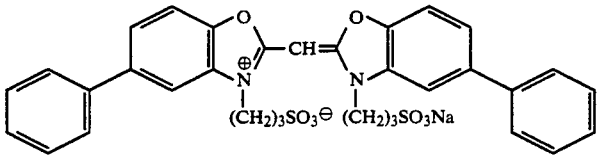

SD-10

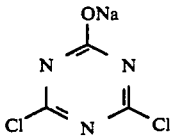

H-1

$(CH_2{=}CHSO_2CH_2)_2O$

H-2

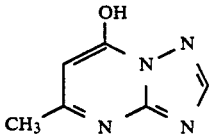

ST-1

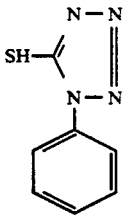

AF-1

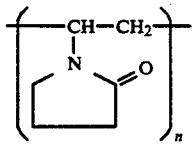

n: degree of polymerization

The samples prepared as above were wedge-exposed to a white light and then processed under the following conditions:

| Process A | Processing time | Processing temperature | Replenished volume* |
|---|---|---|---|
| Color developing | 3 min 15 sec | 38 °C. | 536 ml |
| Bleaching | 45 sec | 38° C. | 134 ml |
| Fixing | 1 min 30 sec | 38° C. | 536 ml |

-continued

| Process A | Processing time | Processing temperature | Replenished volume* |
|---|---|---|---|
| Stabilizing** | 90 sec | 38° C. | 536 ml |

-continued

| Process A | Processing time | Processing temperature | Replenished volume* |
|---|---|---|---|
| Drying | 1 min | 40 to 70° C. | |

Notes
*Replenished volumes are values per square meter of a light-sensitve material.
**The 1st and 2nd tanks of the stabilizing bath were arranged in a counter current mode, and replenishment was made to the 2nd tank.

Compositions of the processing solutions used in the above processes are as follows:

| (Color developer solution) | |
|---|---|
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)aniline sulfate | 4.5 g |
| Diethylenetriamine pentacetic acid | 3.0 g |
| Potassium hydroxide | 1.2 g |

Water was added to make 1 liter, and pH was adjusted to 10.06 with potassium hydroxide or a 20% sulfuric acid.

| (Color developer replenishing solution) | |
|---|---|
| Potassium carbonate | 35 g |
| Sodium hydrogencarbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxylethyl)aniline sulfate | 5.8 g |
| Potassium hydroxide | 2 g |
| Diethylenetriamine pentacetic acid | 3.0 g |

Water was added to make 1 liter, and pH was adjusted to 10.12 with potassium hydroxide or a 20% sulfuric acid.

The bleacher tank solution, fixer tank solution, stabilizer tank solution and respective replenishing solutions were the same as those used in Example 1.

In parallel with the above process A, the color paper prepared and wedge-exposed in Example 1 was processed using the processing solutions employed in Example 1 under conditions of experiment No. 1–6. This is referred to as process B.

Experiment 2-1

Process A (color negative film)

(color developer)—(bleacher)—(fixer)—(stabilizer)

Process B (color paper)

(color developer)—(bleacher)—(fixer)—(stabilizer)

A parallel running treatment illustrated above was conducted by replenishing processing solutions to respective processing baths. In this running treatment, all the bleacher solution overflowed in process A was used as are plenishing solution in process B.

That is, the piping was arranged in advance so as to flow (replenish) all the overflowed bleacher solution for color negative film to the bleaching bath for color papers. The running treatment was continued till the replenished volume of the bleacher solution came to twice the volume of the bleacher tank solution for color papers (this is called 2 rounds and abbreviated to 2R). In this parallel running treatment, the processing rate of color paper and that of color negative film were kept at a constant ratio, at which 24 sheets of E-sized color paper (8.2 cm×11.7 cm) were processed while 1 roll of color negative film (135 size, 24 exposures) was processed.

Experiment 2-2

The color paper was running-treated only by process B. This running treatment was conducted 2 rounds (2 R) as with experiment 2-1. Replenishment of the bleacher solution was made at a rate of 20 ml/m$^2$.

Experiments 2-3 to 2-6

Running treatments were conducted in the same manner as in experiment 2-1, except that types of oxidizing agents were changed as shown in Table 2. The color paper was evaluated in the same manner as in Example 1, at the start and after completion (after 2 R) of the running treatment. Further, the processing solutions after the running treatment were preserved at 38° C. and then checked for generation of tar.

TABLE 2

| Experiment No. | Organic acid iron complex salt: Compound | Organic acid iron complex salt: Addition amount (mol/l) | pH | Yellow density of unexposed portion: At the start | Yellow density of unexposed portion: After completion | Residual silver amount of exposed portion (mg/100 cm$^2$): At the start | Residual silver amount of exposed portion (mg/100 cm$^2$): After completion | Tarring | Remarks |
|---|---|---|---|---|---|---|---|---|---|
| 2-1 | (A-1).Fe | 0.30 | 4.5 | 0.08 | 0.06 | 0.0 | 0.0 | A | Invention |
| 2-2 | (A-1).Fe | 0.30 | 4.5 | 0.08 | 0.08 | 0.0 | 0.0 | A | Invention |
| 2-3 | EDTA.Fe | 0.30 | 4.5 | 0.08 | 0.10 | 0.8 | 1.0 | B | Comparision |
| 2-4 | EDTMP.Fe | 0.30 | 4.5 | 0.08 | 0.10 | 0.7 | 0.9 | C | Comparision |
| 2-5 | (B-1).Fe | 0.30 | 4.5 | 0.08 | 0.06 | 0.0 | 0.0 | A | Invention |
| 2-6 | (A-1).Fe/ (A-1).Fe | 0.15/ 0.15 | 4.5 | 0.08 | 0.08 | 0.0 | 0.0 | A | Invention |

EXAMPLE 3

Using the color paper and processing solutions prepared in Example 1, a running treatment was conducted according to process (1), while varying the replenishing volume of the bleacher solution as shown below. This running treatment was carried out till the replenished volume of the bleacher solution came to twice the volume of the bleacher tank solution for color paper.

TABLE 3

| Experiment No. | Organic acid iron complex salt: Compound | Organic acid iron complex salt: Addition amount (mol/l) | pH | Yellow density of unexposed portion: At the start | Yellow density of unexposed portion: After completion | Residual silver amount of exposed portion (mg/100 cm²): At the start | Residual silver amount of exposed portion (mg/100 cm²): After completion | Tarring | Replenished volume (ml/cm²) | Remarks |
|---|---|---|---|---|---|---|---|---|---|---|
| 3-1 | EDTA.Fe | 0.30 | 4.5 | 0.07 | 0.08 | 0.8 | 0.8 | A | 60 | Comp. |
| 3-2 | EDTA.Fe | 0.30 | 4.5 | 0.07 | 0.08 | 0.8 | 0.8 | A | 50 | Comp. |
| 3-3 | EDTA.Fe | 0.30 | 4.5 | 0.07 | 0.16 | 0.8 | 1.8 | C | 30 | Comp. |
| 3-4 | EDTA.Fe | 0.30 | 4.5 | 0.07 | 0.25 | 0.8 | 2.6 | D | 10 | Comp. |
| 3-5 | CyDTA.Fe | 0.30 | 4.5 | 0.07 | 0.13 | 0.8 | 1.2 | B | 30 | Comp. |
| 3-6 | (A-1).Fe | 0.30 | 4.5 | 0.08 | 0.07 | 0.0 | 0.0 | A | 60 | Inv. |
| 3-7 | (A-1).Fe | 0.30 | 4.5 | 0.08 | 0.08 | 0.0 | 0.0 | A | 50 | Inv. |
| 3-8 | (A-1).Fe | 0.30 | 4.5 | 0.08 | 0.08 | 0.0 | 0.0 | A | 30 | Inv. |
| 3-9 | (A-1).Fe | 0.30 | 4.5 | 0.08 | 0.09 | 0.0 | 0.1 | A-B | 10 | Inv. |
| 3-10 | (B-1).Fe | 0.30 | 4.5 | 0.08 | 0.07 | 0.0 | 0.0 | A | 30 | Inv. |
| 3-11 | (A-1).Fe/ (B-1).Fe | 0.15/ 0.15 | 4.5 | 0.08 | 0.08 | 0.0 | 0.0 | A | 30 | Inv. |

Comp.: Comparison
Inv.: Invention

EXAMPLE 4

Samples were prepared by varying coating weights of silver in the color paper prepared in Example 1 as shown in Table 4, while adjusting coating weights of couplers so as to make gradations after wedge exposure and processing approximate to one another. These samples were evaluated in the same manner as in Example 1 [process (1) was employed].

TABLE 4

| No. | Coating weight of silver (mg/100 m²) |
|---|---|
| 4-1 | 8.5 |
| 4-2 | 7.5 |
| 4-3 | 6.5 |
| 4-4 | 5.5 |

It was found from the evaluation results that when the coating weight of silver was less than 7.5 mg/100 cm², the effect of the invention was noticeable, particularly, desilverizing capability was greatly improved.

EXAMPLE 5

After subjecting the color paper prepared in Example 1 to wedge exposure, time step experiments of the bleacher were made with processing solutions which had undergone the running treatment. The results are shown in Table 5.

TABLE 5

| Experiment No. | Organic acid iron complex salt: Compound | Organic acid iron complex salt: Addition amount (mol/l) | pH | 60" (1) | 60" (2) | 40" (1) | 40" (2) | 30" (1) | 30" (2) | 25" (1) | 25" (2) | 20" (1) | 20" (2) |
|---|---|---|---|---|---|---|---|---|---|---|---|---|---|
| 5-1 | EDTA.Fe | 0.30 | 4.5 | 0.06 | 0.1 | 0.07 | 0.1 | 0.08 | 0.3 | 0.08 | 0.8 | 0.18 | 1.9 |
| 5-2 | CyDTA.Fe | 0.30 | 4.5 | 0.06 | 0.0 | 0.07 | 0.1 | 0.08 | 0.4 | 0.07 | 0.9 | 0.21 | 1.8 |
| 5-3 | (A-1).Fe | 0.30 | 4.5 | 0.06 | 0.0 | 0.07 | 0.0 | 0.08 | 0.0 | 0.08 | 0.0 | 0.08 | 0.1 |
| 5-4 | (B-1).Fe | 0.30 | 4.5 | 0.06 | 0.0 | 0.07 | 0.0 | 0.08 | 0.0 | 0.07 | 0.0 | 0.08 | 0.1 |
| 5-5 | (A-1).Fe/ (B-1).Fe | 0.15/ 0.15 | 4.5 | 0.06 | 0.0 | 0.07 | 0.0 | 0.07 | 0.0 | 0.07 | 0.1 | 0.08 | 0.1 |

Notes
(1) Yellow density of unexposed portion
(2) Residual silver amount of exposed portion (mg/100 cm²)

EXAMPLE 6

The paper prepared in Example 1 was exposed through an optical wedge and then subjected to a running treatment in the same manner as in experiment No. 1-6 of Example 1, except that the following solution was used as a developer.

| (Color developer tank solution) | |
|---|---|
| Diethylene glycol | 15 g |
| Potassium bromide | 0.01 g |
| Potassium chloride | 2.3 g |
| Potassium sulfite (50% solution) | 0.5 ml |
| Color developing agent (3-methyl-4-amino-N-ethyl-N-(β-methanesulfonamidoethyl)-aniline sulfate) | 6 g |
| Diethylhydroxylamine (85%) | 5 g |
| Triethanol amine | 10 g |
| Potassium carbonate | 30 g |
| Ethylenediamine tetracetic acid | 2 g |
| Flourescent brightening agent (see Table 4) | 2 g |

Water was added to make the total volume 1 liter, and then the pH was adjusted to 10.15 with potassium hydroxide or sulfuric acid.

| (Color developer replenishing solution) | |
|---|---|
| Diethylene glycol | 17 g |
| Potassium chloride | 3 g |
| Potassium sulfite (50% solution) | 1.0 ml |
| Color developing agent (3-methyl-4-amino-N-ethyl-N-(β-methanesulfonamidoethyl)-aniline sulfate) | 8.8 g |
| Diethylhydroxylamine (85%) | 7 g |
| Triethanol amine | 10 g |
| Potassium carbonate | 30 g |
| Ethylenediamine tetracetic acid | 2 g |
| Flourescent brightening agent (see Table 4) | 2.5 g |

Water was added to make the total volume 1 liter, and then the pH was adjusted to 11.0 with potassium hydroxide or sulfuric acid.

The sample was evaluated in the same manner as in Example 1, the results are shown in Table 6.

TABLE 6

| Experiment No. | Brightener | Yellow density in unexposed portion | Amount of residual silver in exposed portion | Tarring |
|---|---|---|---|---|
| 6-1 | E-34 | 0.08 | 0.0 | A |
| 6-2 | not added | 0.10 | 0.0 | A to B |
| 6-3 | ① | 0.09 | 0.1 | A to B |
| 6-4 | ② | 0.09 | 0.0 | B |
| 6-5 | ③ | 0.09 | 0.1 | A to B |

Brightener ①

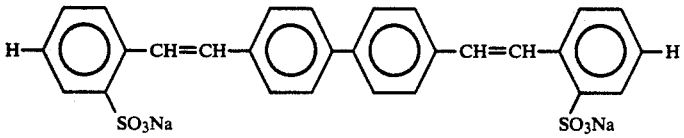

Brightener ②

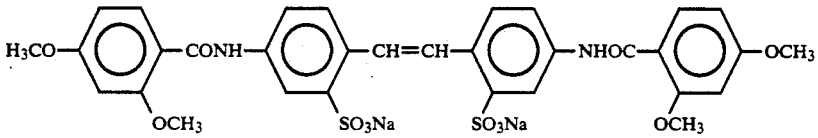

Brightener ③

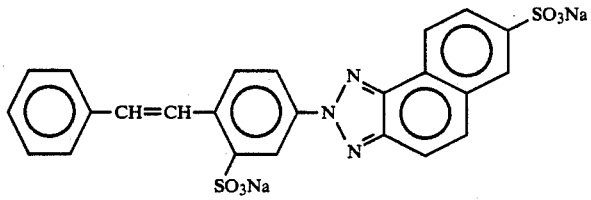

As apparent from Table 4, the object of the invention can be well achieved by the addition of the fluorescent brightener represented by Formula (E).

What is claimed is:

1. A method of processing a silver halide color photographic light-sensitive material having a silver halide emulsion layer containing silver halide grains having a silver chloride content of not less than 80 mol %, wherein said silver halide color photographic material is color-developed and then processed with a bleaching solution (BL-1) comprising at least one of ferric complex salts of compounds represented by the following formula A or B:

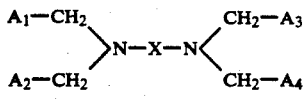

Formula A wherein $A_1$ through $A_4$, which may be the same or different from each other, each represent $-CH_2OH$, $-COOM$ or $-PO_3M_1M_2$; M, $M_1$ and $M_2$ each represent a hydrogen atom, an alkali metal atom or an ammonium group and X represents a substituted or unsubstituted alkylene group having three to six carbon atoms, and

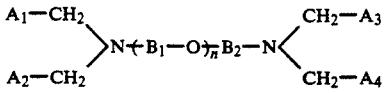

Formula B wherein $A_1$ through $A_4$ are the same as those defined for Formula A; n represents an integer of 1 to 8; and $B_1$ and $B_2$, which may be the same or different from each other, each represent substituted or unsubstituted alkylene group having two to five carbon atoms;

a replenishing volume of said bleaching solution (BL-1) is not more than 50 ml per $m^2$ of said silver halide color photographic material; and the processing time with said bleaching solution is not longer than 40 seconds, and wherein said silver halide color photographic material is developed with a color developer containing a compound represented by the following Formula E,

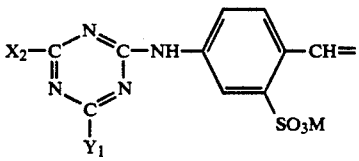

Formula E

-continued

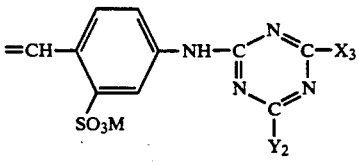

wherein $X_2$, $X_3$, $Y_1$ and $Y_2$ each represent a hydroxy group, halogen atom, alkyl group, aryl group,

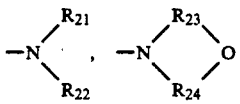

or —$OR_{25}$, wherein $R_{21}$ and $R_{22}$ each represent a hydrogen atom, alkyl group or aryl group; $R_{23}$ *and* $R_{24}$ each represent an alkylene group; $R_{25}$ represents a hydrogen atom, alkyl group or aryl group; and M represents a cation.

2. A method of claim 1, wherein said bleaching solution (BL-1) contains said ferric complex salt in an amount of 0.2 to 1.5 mol per liter of said bleaching solution.

3. A method of claim 1, wherein a pH value of said bleaching solution (BL-1) is not more than 5.5.

4. A method of claim 3, wherein a pH value of said bleaching solution (BL-1) is in the range of 2.5 to 5.5.

5. A method of claim 1, wherein said replenishing volume is not more than 30 ml per $m^2$ of said silver halide color photographic material.

6. A method of claim 1, wherein a part or the whole of the overflowing solution from a bath having a bleaching solution (BL-2) which has been used independently for processing another kind of silver halide color photographic material is replenished to said bleaching solution (BL-1).

7. A method of claim 6, wherein a part or the whole of the overflowing solution from a bath having a bleaching solution used for processing color photographic negative film is replenished to the bleaching solution for processing color photographic negative paper.

8. A method of claim 1, wherein said silver halide color photographic material has not more than 0.75 g per $m^2$ of coating weight of silver; said bleaching solution (BL-1) contains said ferric complex salt in an amount of 0.2 to 1.5 mol per liter of said bleaching solution; and pH value of said bleaching solution is in the range of 2.5 to 5.5.

* * * * *